US011081056B2

(12) United States Patent
Park et al.

(10) Patent No.: US 11,081,056 B2
(45) Date of Patent: Aug. 3, 2021

(54) ORGANIC LIGHT EMITTING DISPLAY DEVICE AND DRIVING METHOD THEREOF

(71) Applicant: SAMSUNG DISPLAY CO., LTD., Yongin-si (KR)

(72) Inventors: Jun Hyun Park, Yongin-si (KR); Young Wan Seo, Yongin-si (KR); An Su Lee, Yongin-si (KR); Kang Moon Jo, Yongin-si (KR); Chong Chul Chai, Yongin-si (KR)

(73) Assignee: SAMSUNG DISPLAY CO., LTD, Yongin-si (KR)

( * ) Notice: Subject to any disclaimer, the term of this patent is extended or adjusted under 35 U.S.C. 154(b) by 226 days.

(21) Appl. No.: 15/989,673

(22) Filed: May 25, 2018

(65) Prior Publication Data

US 2019/0035336 A1 Jan. 31, 2019

(30) Foreign Application Priority Data

Jul. 26, 2017 (KR) ..... 10-2017-0094817

(51) Int. Cl.
*G09G 3/3266* (2016.01)
*G09G 3/3225* (2016.01)
*G09G 3/3233* (2016.01)

(52) U.S. Cl.
CPC ..... *G09G 3/3266* (2013.01); *G09G 3/3225* (2013.01); *G09G 3/3233* (2013.01);
(Continued)

(58) Field of Classification Search
CPC .. G09G 3/3266; G09G 3/3233; G09G 3/3225; G09G 2300/0866;
(Continued)

(56) References Cited

U.S. PATENT DOCUMENTS 7,768,485 B2 8/2010 Uchino et al.
9,105,236 B2 8/2015 Shim et al.
(Continued)

FOREIGN PATENT DOCUMENTS

KR 10-2014-0025781 A 3/2014
KR 10-2014-0056697 A 5/2014
(Continued)

OTHER PUBLICATIONS

S.M. Choi, A Self-compensated Voltage Programming Pixel Structure for Active-Matrix Organic Light Emitting Diodes, pp. 535-538, 2003.
(Continued)

*Primary Examiner* — Patrick N Edouard
*Assistant Examiner* — Douglas M Wilson
(74) *Attorney, Agent, or Firm* — Kile Park Reed & Houtteman PLLC

(57) ABSTRACT

An organic light emitting display device includes a plurality of pixels. A pixel on an ith horizontal line includes a first transistor coupled between a first power source and a first node and having a gate electrode coupled to a second node. An organic light emitting diode is coupled between the first node and a second power source. A second transistor is coupled between the second and third nodes and is turned on when a first scan signal is supplied to an ith first scan line. A third transistor is coupled between the third and first nodes. A first capacitor is coupled between an ith control line and the second node. A second capacitor is coupled between the third node and a data line. The pixels are simultaneously driven during first, second, and third periods of a frame period and sequentially driven during a fourth period of the frame period.

31 Claims, 17 Drawing Sheets

(52) U.S. Cl.
CPC ..... *G09G 2300/0814* (2013.01); *G09G 2300/0819* (2013.01); *G09G 2300/0847* (2013.01); *G09G 2300/0852* (2013.01); *G09G 2300/0861* (2013.01); *G09G 2300/0866* (2013.01); *G09G 2310/0205* (2013.01); *G09G 2310/0251* (2013.01); *G09G 2310/0262* (2013.01); *G09G 2320/043* (2013.01); *G09G 2320/045* (2013.01)

(58) Field of Classification Search
CPC ... G09G 2300/0847; G09G 2300/0819; G09G 2300/0861; G09G 2310/0262; G09G 2300/0852; G09G 2320/043; G09G 2320/045; G09G 2300/0814; G09G 2310/0251; G09G 2310/0205; H01L 27/3244; H01L 27/3265
See application file for complete search history.

(56) References Cited

U.S. PATENT DOCUMENTS

2011/0109531 A1* 5/2011 Choi ..... G09G 3/3233 345/76
2013/0222356 A1* 8/2013 Jeong ..... G09G 3/3233 345/211
2014/0071108 A1* 3/2014 Han ..... G09G 3/3233 345/211
2014/0333515 A1* 11/2014 In ..... G09G 3/3233 345/82
2015/0243222 A1* 8/2015 Lee ..... G09G 3/3291 345/82
2016/0148569 A1* 5/2016 Park ..... G09G 3/3233 345/212
2016/0275869 A1 9/2016 Hwang et al.
2017/0337872 A1 11/2017 Chai et al.
2018/0166010 A1 6/2018 Park et al.
2018/0204510 A1* 7/2018 Chung ..... G09G 3/3233
2019/0237020 A1* 8/2019 Park ..... G09G 3/3233

FOREIGN PATENT DOCUMENTS

KR 10-1424693 B1 7/2014
KR 10-1528147 B1 6/2015
KR 10-2017-0130681 11/2017
KR 10-2018-0068368 A 6/2018

OTHER PUBLICATIONS

B.W. Lee, Novel Simultaneous Emission Driving Scheme for Crosstalk-free 3D AMOLED TV, pp. 758-761, 2010.

* cited by examiner

ORGANIC LIGHT EMITTING DISPLAY DEVICE AND DRIVING METHOD THEREOF

CROSS-REFERENCE TO RELATED APPLICATION

Korean Patent Application No. 10-2017-0094817, filed on Jul. 26, 2017, and entitled, "Organic Light Emitting Display Device and Driving Method Thereof," is incorporated by reference herein in its entirety.

BACKGROUND

1. Field

One or more embodiments described herein relate to an organic light emitting display device and a method for driving an organic light emitting display device.

2. Description of the Related Art

A variety of displays have been developed. Examples include liquid crystal displays and organic light emitting displays. An organic light emitting display generates images based on light emitted from pixels that include organic light emitting diodes. Each organic light emitting diode emits based on a recombination of electrons and holes in an organic layer.

In addition to the foregoing features, each pixel circuit is coupled to a data line and a scan line, and includes a driving transistor for controlling an amount of current flowing through an associated organic light emitting diode. The amount of current is controlled based on a data signal, and light of a predetermined luminance is emitted based on the amount of current.

Each pixel circuit may also include a number of transistors and capacitors to compensate for a variation in the threshold voltage of the driving transistor. The pixels may be driven in units of horizontal lines while compensating for the threshold voltages of the driving transistors. However, as the resolution of display increases, the horizontal period becomes shorter. As a result, it may be difficult to sufficiently compensate for the variation in threshold voltages of the pixel driving transistors.

SUMMARY

In accordance with one or more embodiments, an organic light emitting display device includes a plurality of pixels which includes a pixel on an ith (i is a natural number) horizontal line, the pixel on the ith horizontal line including: a first transistor coupled between a first power source and a first node, the first transistor having a gate electrode coupled to a second node; an organic light emitting diode coupled between the first node and a second power source; at least one second transistor coupled between the second node and a third node, the at least one second transistor to be turned on when a first scan signal is supplied to an ith first scan line; at least one third transistor coupled between the third node and the first node; a first capacitor coupled between an ith control line and the second node; and a second capacitor coupled between the third node and a data line, wherein the pixels are to be simultaneously driven during a first period, a second period, and a third period of a frame period and are to be sequentially driven during a fourth period of the frame period.

The at least one third transistor may be turned on when a first scan signal is supplied to an (i+1)th scan line. The display device may include a first scan driver to simultaneously supply the first scan signal to the first scan lines during the second period and the third period and to sequentially supply the first scan signal to the first scan lines during the fourth period.

The display device may include a first power driver to supply a first power source having a first voltage during the first period and the second period, supply a first power source having a second voltage less than the first voltage during the third period, and supply a first power source having a third voltage greater than the first voltage during the fourth period. The first voltage may be equal to or less than the voltage of the second power source, and the third voltage may cause the pixels to emit light.

The display device may include a control driver to simultaneously supply a control signal to the control lines during the first period and the second period and to sequentially supply the control signal to the control lines during the fourth period. The control driver may supply the control signal to the ith control line after the first scan signal is supplied to the ith first scan line during the fourth period. The he first transistor, the at least one second transistor, and the at least one third transistor may be N-type transistors, and a voltage of the second node may be increased when the control signal is supplied to the ith control line.

The at least one second transistor may include a plurality of second transistors coupled in series. The at least one third transistor may include a plurality of third transistors coupled in series. The display device may include a second scan line commonly coupled to a gate electrode of the at least one third transistor in respective ones of the pixels. The display device may include a second scan driver to supply a second scan signal to the second scan line during the second period and the third period. The pixel on the ith horizontal line may include a fourth transistor coupled between the first node and the ith control line, and the fourth transistor may have a gate electrode coupled to a third scan line commonly coupled to the pixels.

The display device may include a third scan driver to supply a third scan signal to the third scan line during the first period and the second period. The display device may include a first power driver to supply a first power source having a second voltage during the third period and supply a first power source having a third voltage greater than the second voltage during the other periods. The display device may include a control driver to sequentially supply a control signal to the control lines during the fourth period.

In accordance with one or more other embodiments, an organic light emitting display device includes a plurality of blocks, each including at least two horizontal lines; first scan lines corresponding to respective ones of the horizontal lines; control lines corresponding to respective ones of the blocks; and a control driver to drive the control lines.

A pixel on an ith (i is a natural number) horizontal line of a kth (k is a natural number) block includes a first transistor coupled between a first power source and a first node, the first transistor having a gate electrode coupled to a second node; an organic light emitting diode coupled between the first node and a second power source; a second transistor coupled between the second node and a third node, the second transistor to be turned on when a first scan signal is supplied to an ith first scan line: a third transistor coupled between the third node and the first node, the third transistor to be turned on when a first scan signal is supplied to an (i+1)th first scan line; a first capacitor coupled between a kth control line and the second node; and a second capacitor coupled between the third node and a data line, wherein the pixels are to be simultaneously driven during a first period, a second period, and a third period of a frame period and sequentially driven during a fourth period of the frame period.

The control driver may simultaneously supply a control signal to the control lines during the first period and the second period and may sequentially supply the control signal to the control lines in the fourth period. The first transistor, the second transistor, and the third transistor may be N-type transistors, and a voltage of the second node may be increased when the control signal is supplied to the kth control line. The control driver may supply a control signal to the kth control line after the first scan signal is supplied to first scan lines in the kth block during the fourth period.

The display device may include a first scan driver to simultaneously supply the first scan signal to the first scan lines during the second period and the third period and sequentially supply the first scan signal to the first scan lines during the fourth period. The display device may include a first power driver to supply a first power source having a first voltage during the first period and the second period, supply a first power source having a second voltage less than the first voltage during the third period, and supply a first power source having a third voltage greater than the first voltage during the fourth period.

In accordance with one or more other embodiments, an organic light emitting display device includes a plurality of pixels including a pixel on an ith (i is a natural number) horizontal line, the pixel including: a first transistor coupled between a first power source and a first node, the first transistor having a gate electrode coupled to a second node; an organic light emitting diode coupled between the first node and a second power source; a second transistor coupled between the second node and a third node, the second transistor to be turned on when a first scan signal is supplied to an ith first scan line; a third transistor coupled between the third node and the first node, the third transistor to be turned on when a first scan signal is supplied to an (i+1)th first scan line; a fourth transistor coupled between the first power source and the first transistor, the fourth transistor to be turned on when an emission control signal is supplied to an ith emission control line; a first capacitor coupled between a control line commonly coupled to the pixels and the second node; and a second capacitor coupled between the third node and a data line, wherein the pixels are to be simultaneously driven during a first period, a second period, and a third period of a frame period and are to be sequentially driven during a fourth period of the frame period.

The display device may include a control driver to supply a control signal to the control line during the first period and the second period. The first transistor, the second transistor, the third transistor, and the fourth transistor may be P-type transistors, and a voltage of the second node may be decreased when the control signal is supplied to the control line.

The display device may include an emission driver to simultaneously supply the emission control signal to the emission control lines during the first period, the second period, and the third period and sequentially supply the emission control signal to the emission control lines during the fourth period. The emission driver may supply the emission control signal to the ith emission control line after the first scan signal is supplied to the ith first scan line.

The display device may include a first scan driver to simultaneously supply the first scan signal to the first scan lines during the second period and the third period and sequentially supply the first scan signal to the first scan lines during the fourth period. The display device may include a first power driver to supply a first power source having a first voltage during the first period and the second period and supply a first power source having a second voltage greater than the first voltage such that the pixels emit light during the fourth period.

The display device may include a second power driver coupled to a second power source having a third voltage such that the pixels do not emit light during the first period, the second period, and the third period, and to supply a second power source having a fourth voltage less than the third voltage such that the pixels emit light during the fourth period.

In accordance with one or more other embodiments, a method for driving an organic light emitting display device based on a frame period divided into a first period, a second period, a third period, and a fourth period. The method includes during the first period, initializing an anode electrode of an organic light emitting diode in each of pixels to a specific voltage; during the second period, initializing a gate electrode of a driving transistor in each of the pixels to the specific voltage; during a third period, storing a voltage corresponding to a threshold voltage of the driving transistor in a first capacitor in each of the pixels; and during the fourth period, sequentially supplying data signals to the pixels in units of horizontal lines and allowing the pixels to sequentially emit light based on corresponding ones of the data signals.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
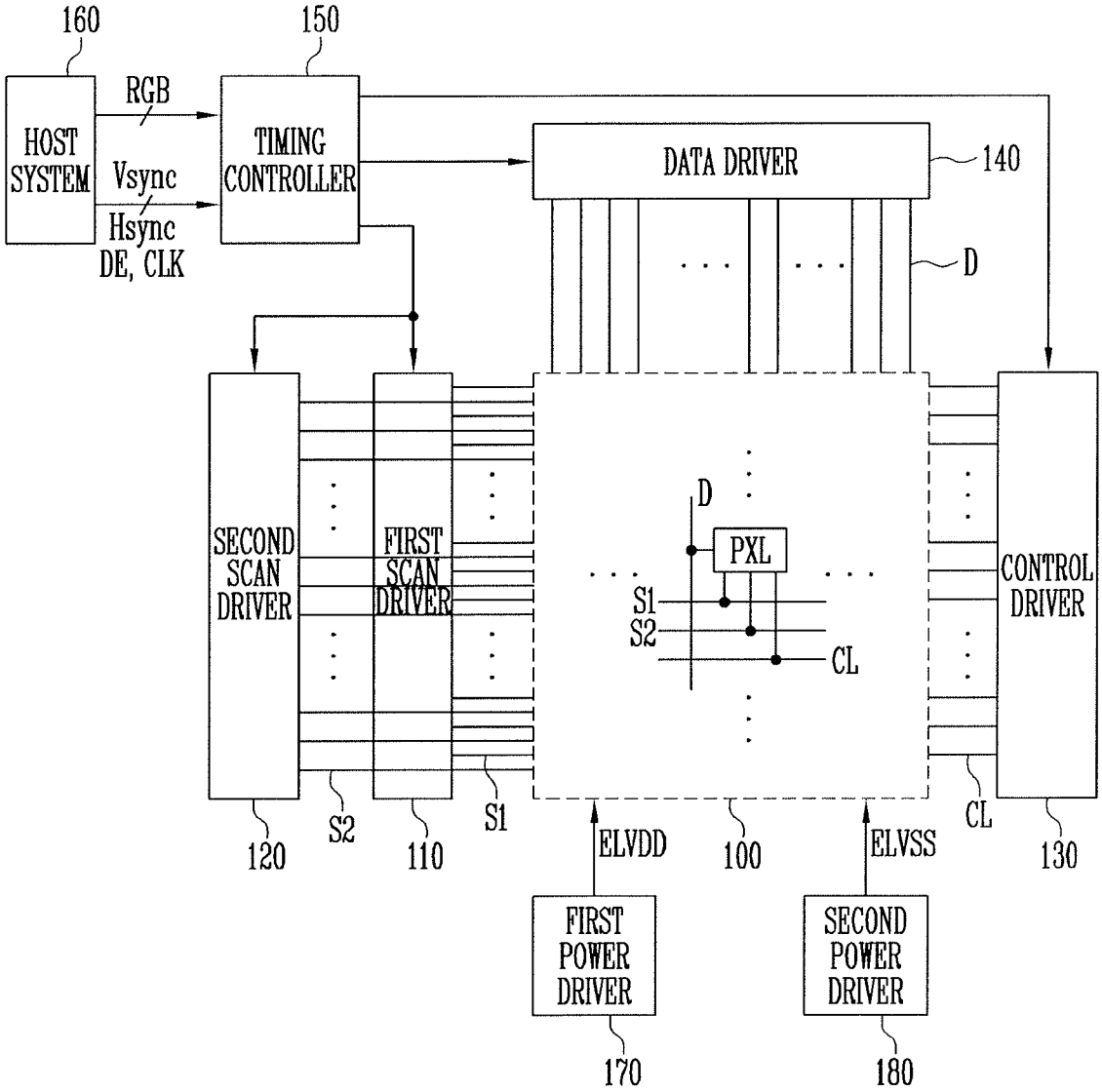
FIG. 1 illustrates an embodiment of an organic light emitting display device.

Example embodiments are described with reference to the drawings; however, they may be embodied in different forms and should not be construed as limited to the embodiments set forth herein. Rather, these embodiments are provided so that this disclosure will be thorough and complete, and will convey exemplary implementations to those skilled in the art. The embodiments (or portions thereof) may be combined to form additional embodiments In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. In addition, when an element is referred to as "including" a component, this indicates that the element may further include another component instead of excluding another component unless there is different disclosure.

FIG. 1 illustrates an embodiment of an organic light emitting display device which includes a pixel unit 100, a first scan driver 110, a second scan driver 120, a control driver 130, a data driver 140, a timing controller 150, a host system 160, a first power driver 170, and a second power driver 180. In an embodiment, one frame period for driving the organic light emitting display device is divided into a first period T1, a second period T2, a third period T3, and a fourth period T4, as shown, for example, in FIG. 4.

The first to third periods T1 to T3 are for initializing pixels PXL, and all of the pixels PXL are simultaneously driven in the first to third periods T1 to T3. The fourth period T4 is a period in which the pixels PXL emit light. The pixels PXL may be sequentially driven in units of horizontal lines in the fourth period T4.

The data driver 140 generates data signals based on image data from the timing controller 150. The data signals generated by the data driver 140 are supplied to data lines D and are synchronized with a first scan signal sequentially supplied to first scan lines S1 during the fourth period T4. The data driver 140 may supply a constant voltage between data signals. The constant voltage may be, for example, a preset predetermined voltage used to initialize the data lines D.

The first scan driver 110 supplies the first scan signal to the first scan lines S1. For example, the first scan driver 110 may simultaneously supply the first scan signal to the first scan lines S1 during the second period T2 and the third period T3, and may sequentially supply the first scan signal to the first scan lines S1 during the fourth period T4. When the first scan signal is supplied to the first scan lines S1, a transistor in each of the pixels PXL is turned on. The first scan signal may be set to a gate-on voltage (e.g., a high voltage) to turn on the transistor in each of the pixels PXL.

The second scan driver 120 supplies a second scan signal to second scan lines S2. For example, the second scan driver 120 may simultaneously supply the second scan signal to the second scan lines S2 during the second period T2 and the third period T3. When the second scan signal is supplied to the second scan lines S2, the transistor in each of the pixels PXL is turned on. The second scan signal is set to the gate-on voltage (e.g., the high voltage) to turn on the transistor in each of the pixels PXL.

The control driver 130 supplies a control signal (e.g., a high voltage) to control lines CL. For example, the control driver 130 may simultaneously supply the control signal to the control lines CL during the first period T1 and the second period T2, and may sequentially supply the control signal to the control lines CL during the fourth period T4. Emission times of the pixels PXL are controlled corresponding to the control signal supplied to the control lines CL during the fourth period T4.

Additionally, the control driver 130 simultaneously supplies the control signal having a first width W1 to the control lines CL during the first period T1 and the second period T2. The control driver 130 also sequentially supplies the control signal having a second width W2 to the control lines CL during the fourth period T4. The second width W2 may be greater than the first width W1.

The timing controller 150 controls the drivers 110, 120, 130, 140, 170, and 180, based on timing signals from the host system 160. Examples of the timing and other signals output from the host include image data RGB, a vertical synchronization signal Vsync, a horizontal synchronization signal Hsync, a data enable signal DE, and a clock signal CLK.

The host system 160 supplies the image data RGB to the timing controller 150 through a predetermined interface. The host system 160 supplies the timing signals Vsync, Hsync, DE, and CLK to the timing controller 150.

The first power driver 170 supplies a first power source ELVDD to the pixels PXL. The first power driver 170 supplies the first power source ELVDD having a first voltage V1 during the first period T1 and the second period T2, and supplies the first power source ELVDD having a second voltage V2 during the third period T3. The first power driver 170 supplies the first power source ELVDD having a third voltage during the fourth period T4. The first voltage V1 may be equal to or less than a voltage of a second power source ELVSS. The second voltage V2 may be less than the first voltage V1. The third voltage V3 may be greater than the first voltage V1, e.g., a voltage at which the pixels PXL emit light.

The second power driver 180 supplies the second power source ELVSS to the pixels PXL. The second power source ELVSS may maintain a constant voltage during one frame period.

The pixel unit 100 includes a plurality of pixels PXL coupled to the data lines D, the first scan lines S1, the second scan lines S2, and the control lines CL. Each pixel PXL emits light with a predetermined luminance that corresponds to a respective one of the data signals.

A second scan line S2*i* (i is a natural number) coupled to a pixel PXL on an ith horizontal line may be set as an (i+1)th first scan line S1*i*+1. In one embodiment, the second scan driver 120 and the second scan lines S2 may be removed as illustrated in FIG. 2.

Figure 2:
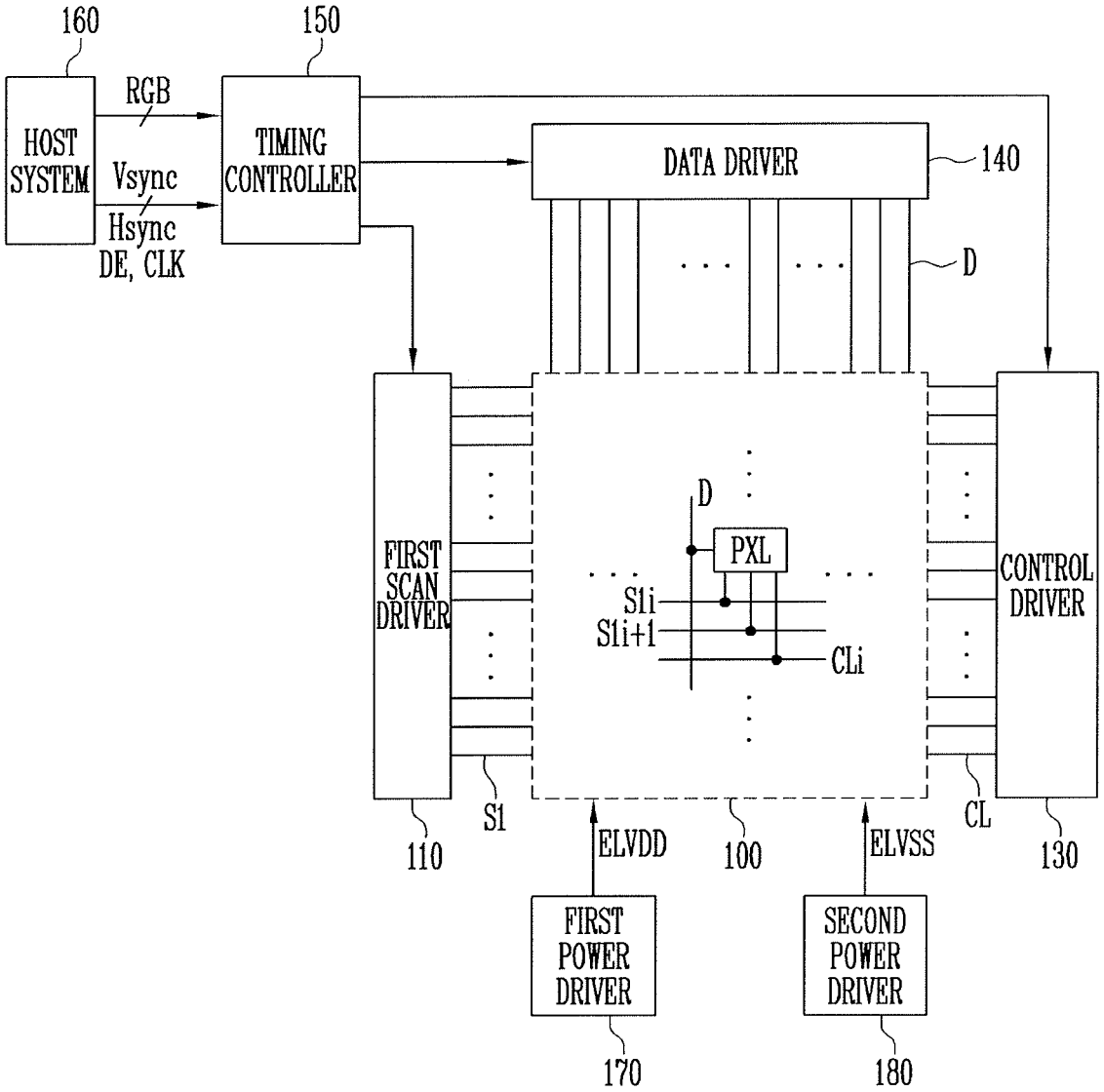
FIG. 2 illustrates another embodiment of an organic light emitting display device.
Figure 3:
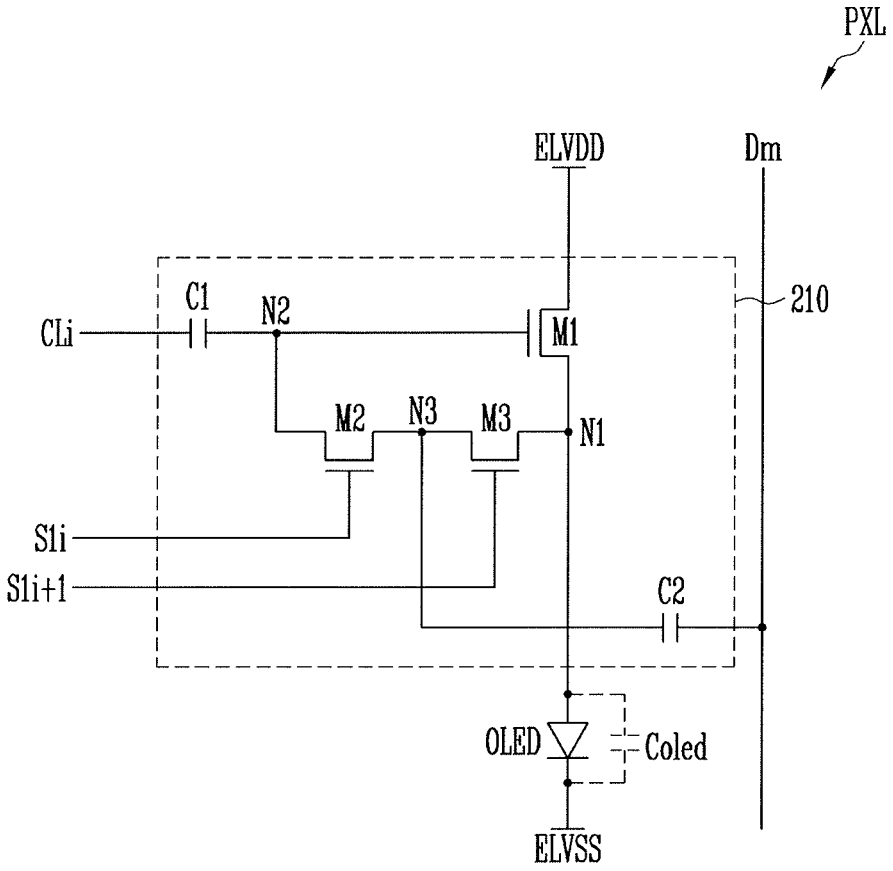
FIG. 3 illustrates an embodiment of a pixel.

FIG. 3 illustrates an embodiment of a pixel, which, for example, may be representative of the pixels PXL illustrated in FIG. 2. In FIG. 3, a pixel PXL on an ith horizontal line is illustrated for convenience of description. In addition, it is assumed that a second scan line S2*i* coupled to the pixel PXL on the ith horizontal line is set as an (i+1)th first scan line S1*i*+1.

Referring to FIG. 3, the pixel PXL includes an organic light emitting diode OLED and a pixel circuit 210 for controlling an amount of current supplied to the organic light emitting diode OLED. The organic light emitting diode OLED has an anode electrode coupled to the pixel circuit 210 and a cathode electrode coupled to the second power source ELVSS. The organic light emitting diode OLED generates light with a predetermined luminance that corresponds to the amount of current supplied from the pixel circuit 210. The pixel circuit 210 controls the amount of current supplied to the organic light emitting diode OLED based on a data signal.

The pixel circuit 210 includes a first transistor M1, a second transistor M2, a third transistor M3, a first capacitor C1, and a second capacitor C2. The first transistor (or driving transistor) M1 is coupled between the first power source ELVDD and a first node N1. The first node N1 is electrically coupled to the anode electrode of the organic light emitting diode OLED. A gate electrode of the first transistor M1 is coupled to a second node N2. The first transistor M1 controls the amount of current flowing from the first power source ELVDD to the second power source ELVSS, via the organic light emitting diode OLED, based on the voltage of the second node N2.

The second transistor M2 is coupled between the second node N2 and a third node N3. A gate electrode of the second transistor M2 is coupled to an ith first scan line S1*i*. The second transistor M2 is turned on when a first scan signal is supplied to the ith first scan line S1*i*, in order to allow the second node N2 and the third node N3 to be electrically coupled to each other.

The third transistor M3 is coupled between the third node N3 and the first node N1. A gate electrode of the third transistor M3 is coupled to an (i+1)th first scan line S1*i*+1 (or an ith second scan line S2*i*). The third transistor M3 is turned on when a first scan signal is supplied to the (i+1)th first scan line S1*i*+1, in order to allow the third node N3 and the first node N1 to be electrically coupled to each other. In one embodiment, the first to third transistors M1 to M3 may be N-type transistors (e.g., NMOS transistors).

The first capacitor C1 is coupled between an ith control line CLi and the second node N2. The first capacitor C1 controls the voltage of the second node N2 based on a control signal supplied to the ith control line CLi. When the transistors M1 to M3 are N-type transistors, the control signal is set to increase the voltage of the second node N2.

The second capacitor C2 is coupled between a data line Dm and the third node N3. The second capacitor C2 controls a voltage of the third node N3 corresponding to the voltage of a data signal supplied to the data line Dm.

Figure 4:
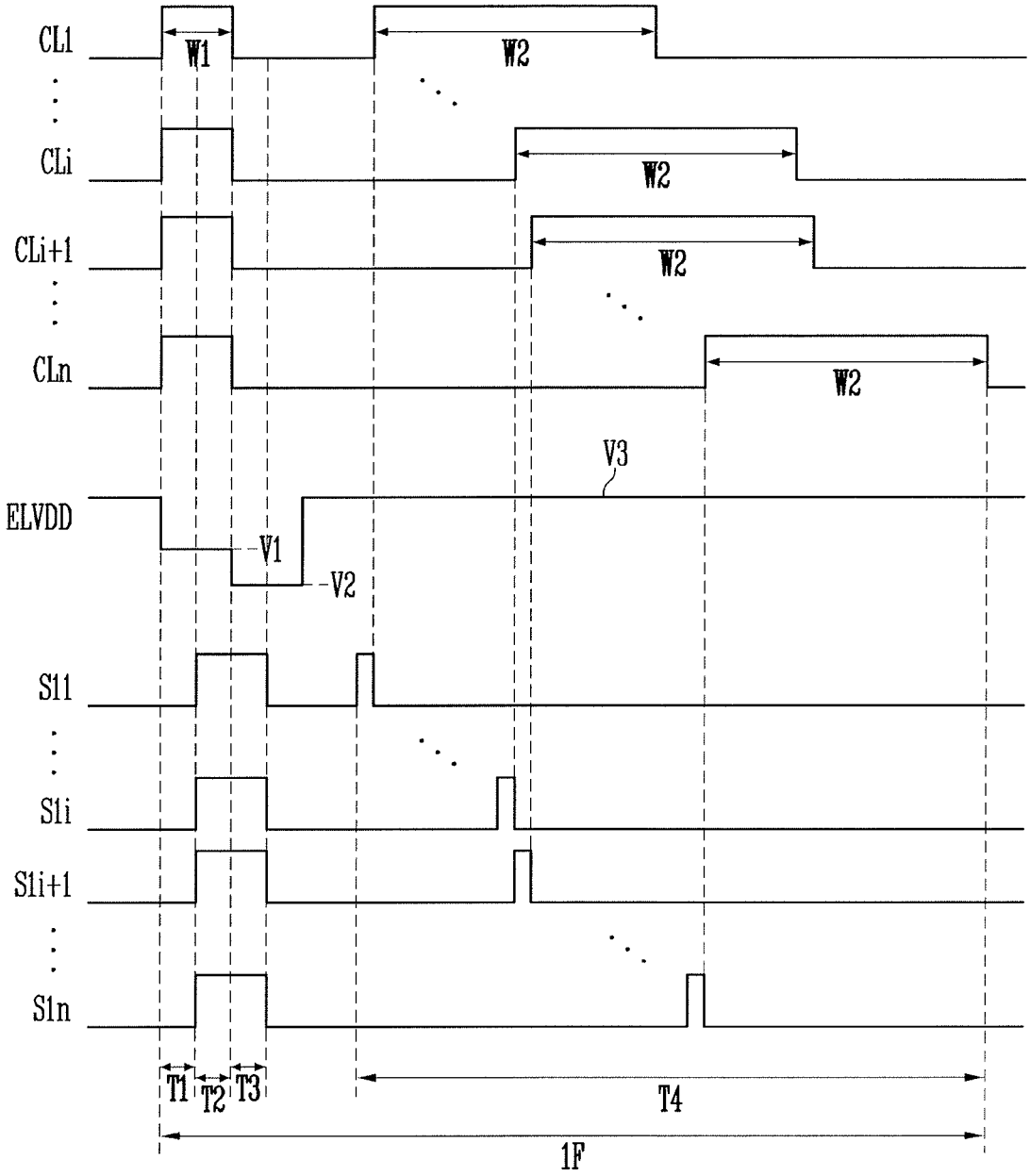
FIG. 4 illustrates a waveform diagram corresponding to an embodiment of a method for driving an organic light emitting display device.

FIG. 4 illustrates a waveform diagram of an embodiment of a method for driving the pixel illustrated in FIG. 3. Referring to FIG. 4, first, a control signal is supplied to control lines CL1 to CLn during a first period T1 and a second period T2 in one frame period 1F. Also, the voltage of the first power source ELVDD is decreased to a first voltage V1 during the first period T1 and the second period T2.

When the control signal is supplied to the ith control line CLi, the voltage of the ith control line CLi is increased. Accordingly, the voltage of the second node N2 is increased. When the voltage of the second node N2 is increased, the first transistor M1 is turned on. The voltage of the control signal may be set to turn on the first transistor M1 regardless of the voltage of the second node N2 applied in a previous frame period.

When the first transistor M1 is turned on, the first power source ELVDD is electrically coupled to the anode electrode of the organic light emitting diode OLED. At this time, the first power source ELVDD is set to a voltage equal to or less than that of the second power source ELVSS. Accordingly, an organic capacitor Coled, equivalently formed in the organic light emitting diode OLED, is discharged. As a result, the anode electrode of the organic light emitting diode OLED is initialized to approximately the first voltage V1 during the first period T1.

A first scan signal is simultaneously supplied to first scan lines S11 to S1*n* during the second period T2 and a third period T3. When the first scan signal is supplied to the ith first scan line S1*i* and the (i+1)th first scan line S1*i*+1, the second transistor M2 and the third transistor M3 are turned on.

When the second transistor M2 and the third transistor M3 are turned on, the second node N2 and the first node N1 are electrically coupled to each other. Then, the second node N2 is initialized to approximately the first voltage V1 by a voltage of the organic capacitor Coled.

Supply of the control signal to the control lines CL1 to CLn is stopped in the third period T3. In addition, the voltage of the first power source ELVDD is decreased to a second voltage V2 less than the first voltage V1. The second voltage V2 is set such that the first transistor M1 can maintain a turn-on state regardless of whether supply of the control signal is stopped.

When the first transistor M1 is set to the turn-on state, a predetermined current is supplied from the second node N2 to the first power source ELVDD via the first transistor M1 that is diode-coupled. In this case, a voltage corresponding to a threshold voltage of the first transistor M1 is applied to the second node N2.

The first capacitor C1 stores a voltage between the ith control line CLi and the second node N2 during the third period T3. That is, the voltage corresponding to the threshold voltage of the first transistor M1 is stored in the first capacitor C1 during the third period T3.

All of the pixels PXL are simultaneously driven during the first to third period T1 to T3. Thus, the voltage corresponding to the threshold voltage of the first transistor M1 is stored in the first capacitor C1 in each of the pixels PXL during the first to third periods T1 to T3.

Also, the pixels PXL are simultaneously driven during the first to third periods T1 to T3. Accordingly, sufficient time may be assigned to the first to third periods T1 to T3 to allow for stable compensation of the threshold voltages of the pixels PXL. This may allow a display device with high-resolution panels to be formed.

The first power source ELVDD is set to a third voltage V3 greater than the first voltage V1 during a fourth period T4. The third voltage V3 is set such that the pixels PXL emit light based on a corresponding data signal.

The first scan signal is sequentially supplied to the first scan lines S11 to S1*n* during the fourth period T4. When a first scan signal is supplied to the ith first scan line S1*i*, the second transistor M2 is turned on. When the second transistor M2 is turned on, the second node N2 and the third node N3 are electrically coupled to each other.

Meanwhile, the data signal is supplied to the data line Dm to be synchronized with the first scan signal supplied to the ith first scan line S1*i*. When the data signal is supplied to the data line Dm, voltages of the third node N3 and the second node N2 are changed by coupling of the second capacitor C2. In this case, a variation in voltage of the second node N2 is determined corresponding to the voltage of the data signal supplied to the data line Dm. Accordingly, a voltage corresponding to the data signal is additionally stored in the first capacitor C1.

After the voltage corresponding to the data signal is stored in the first capacitor C1, the third transistor M3 is turned on based on the first scan signal supplied to the (i+1)th first scan line S1*i*+1. At this time, since the second transistor M2 maintains a turn-off state, the voltage of the second node N2 is not changed corresponding to the data signal supplied to the data line Dm. Thus, the first capacitor C1 may stably maintain the voltage of a data signal stored in a previous period.

After the voltage corresponding to the data signal is stored in the first capacitor C1, the control signal is supplied to the ith control line CLi. When the control signal is supplied to the ith control line CLi, the voltage of the second node N2 is increased. At this time, the first transistor M1 supplies a current corresponding to the voltage of the second node N2 to the organic light emitting diode OLED. Accordingly, the organic light emitting diode OLED generates light with a predetermined luminance. When a voltage corresponding to a black data signal is stored in the first capacitor C1, the first transistor M1 maintains the turn-off state regardless of whether the control signal is supplied.

Meanwhile, the control signal supplied to the ith control line CLi is set to a second width W2. Accordingly, pixels PXL on the ith horizontal line are set to an emission state during the fourth period T4. More specifically, the pixels PXL store a voltage corresponding to the data signal in units of horizontal lines, and sequentially emit light corresponding to the control signal.

Figure 5:
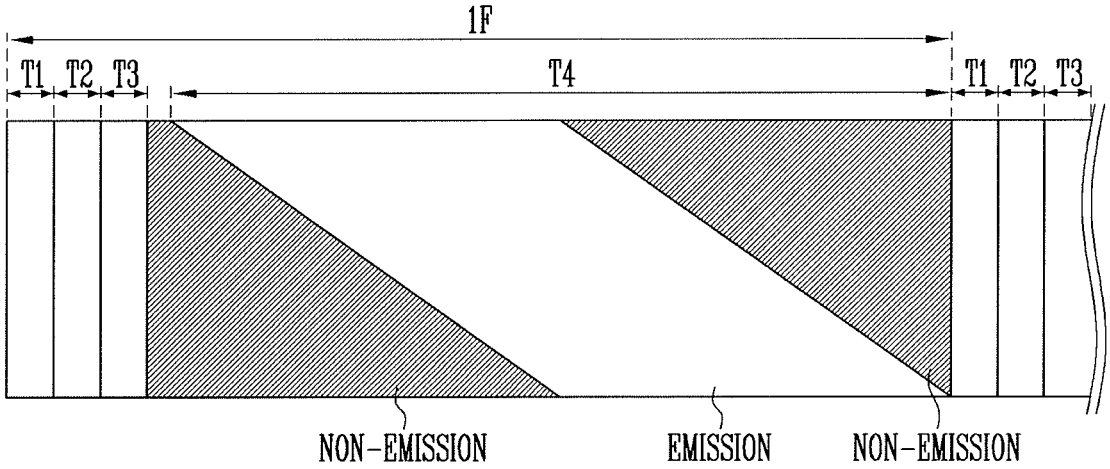
FIG. 5 illustrates an embodiment of one frame period for the driving method.

FIG. 5 illustrates an embodiment of one frame period, which, for example, may correspond to the driving method of FIG. 4. In FIG. 5, a case is illustrated where all of the pixels PXL emit light corresponding to the data signal.

Referring to FIG. 5, the pixels PXL are simultaneously driven during the first to third periods T1 to T3. At this time, a voltage corresponding to the threshold voltage of the first transistor M1 in each of the pixels PXL is stored in an associated first capacitor C1 throughout the first to third periods T1 to T3.

In addition, the pixels PXL are sequentially driven during the fourth period T4. At this time, voltages of corresponding data signals are stored in the pixels PXL in units of horizontal lines during the fourth period T4. After the voltages of the data signals are stored in the pixels PXL, the pixels PXL sequentially emit light in units of horizontal lines. At this time, emission times of the pixels PXL are set equal to one another regardless of the positions of the horizontal lines.

Figure 6:
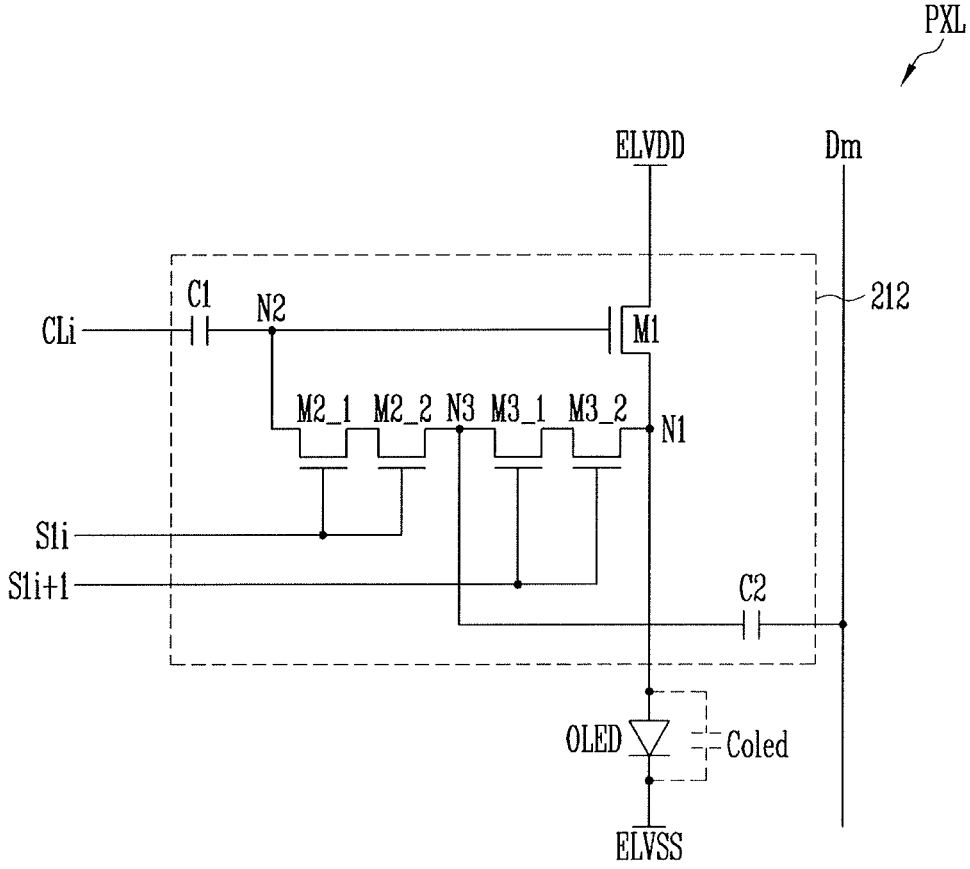
FIG. 6 illustrates another embodiment of a pixel.

FIG. 6 illustrates another embodiment of a pixel shown in FIG. 2. In FIG. 6, components identical to those of FIG. 3 are designated by like reference numerals.

Referring to FIG. 6, the pixel PXL includes an organic light emitting diode OLED and a pixel circuit 212 for controlling an amount of current supplied to the organic light emitting diode OLED.

The organic light emitting diode OLED has an anode electrode coupled to the pixel circuit 212 and a cathode electrode coupled to a second power source ELVSS. The organic light emitting diode OLED generates light with a predetermined luminance that corresponds to an amount of current supplied from the pixel circuit 212. The pixel circuit 212 controls the amount of current supplied to the organic light emitting diode OLED based on a data signal.

The pixel circuit 212 includes a first transistor M1, second transistors M2_1 and M2_2, third transistors M3_1 and M3_2, a first capacitor C1, and a second capacitor C2. The second transistors M2_1 and M2_2 are coupled in series between a second node N2 and a third node N3. Gate electrodes of the second transistors M2_1 and M2_2 are coupled to an ith first scan line S1*i*. When a first scan signal is supplied to the ith first scan line S1*i*, the second transistors M2_1 and M2_2 are turned on to allow the second node N2 and the third node N3 to be electrically coupled to each other.

Additionally, coupling the second transistors M2_1 and M2_2 in series between the second node N2 and the third node N3 may allow leakage current between the second node N2 and the third node N3 to be reduced or minimized. This may improve driving stability.

The third transistors M3_1 and M3_2 are coupled in series between the third node N3 and a first node N1. Gate electrodes of the third transistors M3_1 and M3_2 are coupled to an (i+1)th first scan line S1*i*+1. When a first scan signal is supplied to the (i+1)th first scan line S1*i*+1, the third transistors M3_1 and M3_2 are turned on to allow the third node N3 and the first node N1 to be electrically coupled to each other.

Additionally, coupling the third transistors M3_1 and M3_2 in series between the third node N3 and the first node N1 may allow leakage current between the third node N3 and the first node N1 to be reduced or minimized. This may improve driving stability.

A process for operating the pixel PXL in this embodiment may be substantially identical to that of the pixel PXL of FIG. 3, except that the pixel circuit 212 has a plurality of second transistors M2_1 and M2_2 and a plurality of third transistors M3_1 and M3_2.

Also, in FIG. 6, two second transistors M2_1 and M2_2 and two third transistors M3_1 and M3_2 are provided. In another embodiment, more than two second transistors M2_1 and M2_2 and/or more than two third transistors M3_1 and M3_2 may be coupled in series.

Figure 7:
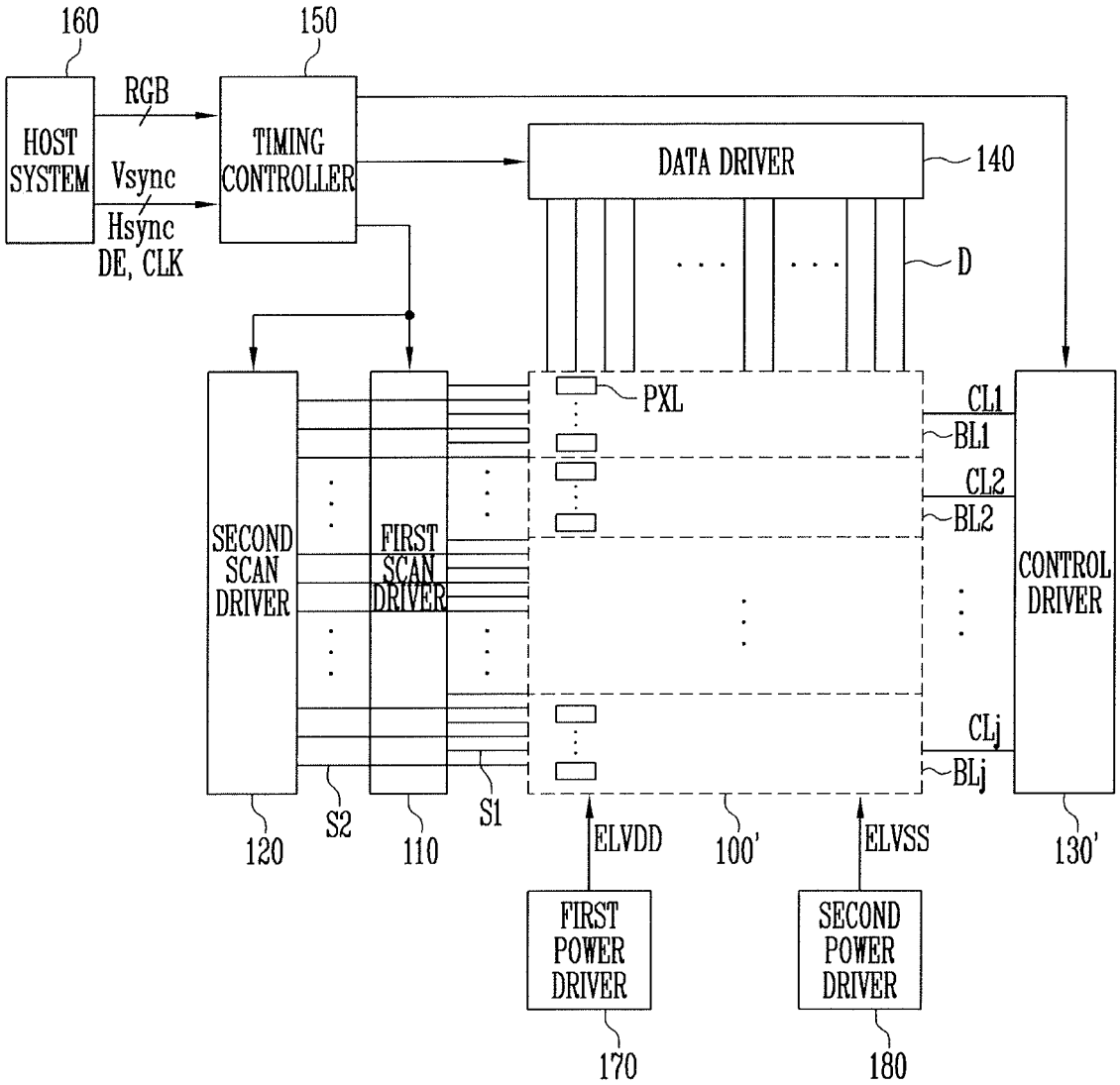
FIG. 7 illustrates another embodiment of an organic light emitting display device.

FIG. 7 illustrates another embodiment of an organic light emitting display device. In FIG. 7, components identical to those of FIG. 1 are designated by like reference numerals.

Referring to FIG. 7, the organic light emitting display device includes a pixel unit 100', a first scan driver 110, a second scan driver 120, a control driver 130', a data driver 140, a timing controller 150, a host system 160, a first power driver 170, and a second power driver 180.

The pixel unit 100' is divided into a plurality of blocks BL1 to BLj. Each block BL includes pixels PXL located on at least two horizontal lines. Pixels PXL in the same block BL are coupled to the same control line CL. Pixels PXL in other blocks BL are coupled to others control lines CL. For example, pixels PXL in a first block BL1 may be commonly coupled to a first control line CL1, and pixels PXL in a kth (k is a natural number) block BLk may be commonly coupled to a kth control line CLk. In this case, emission times of the pixels PXL are controlled in units of blocks BL. For example, the pixels PXL may sequentially emit light in units of blocks BL.

Figure 8:
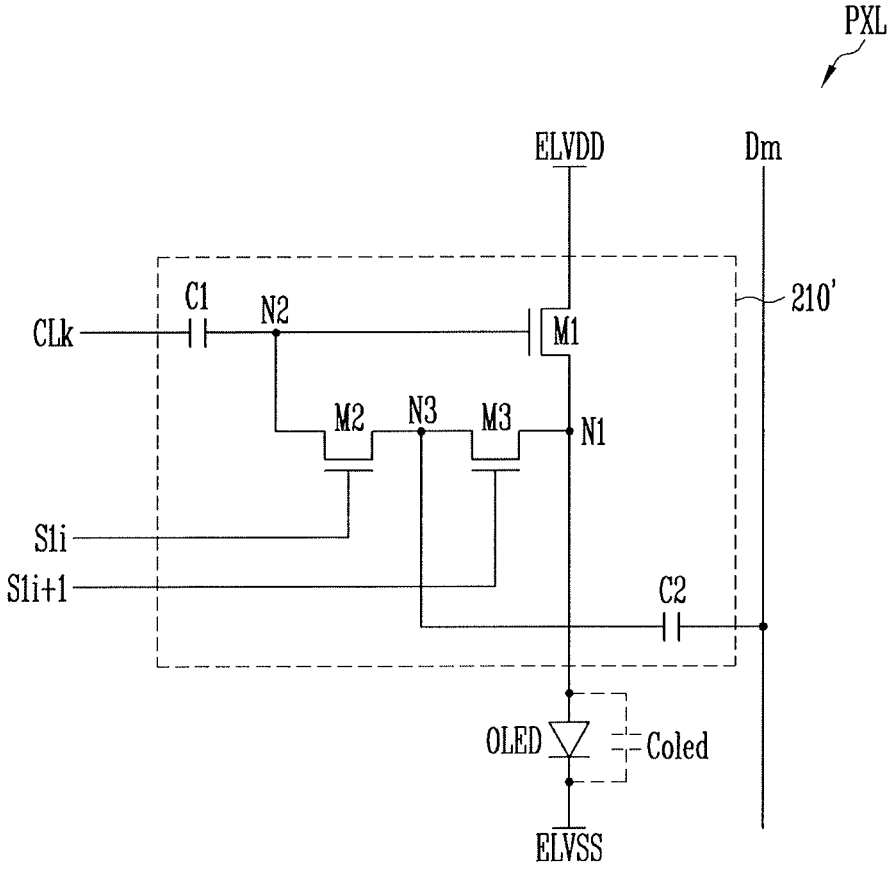
FIG. 8 illustrates another embodiment of a pixel.

Each of the pixels PXL of FIG. 8 include a pixel circuit 210', which may be substantially the same as the pixel circuit 210 of FIG. 3. The pixel PXL coupled to the ith first scan line S1*i* may be coupled to a kth control line CLk.

Figure 9:
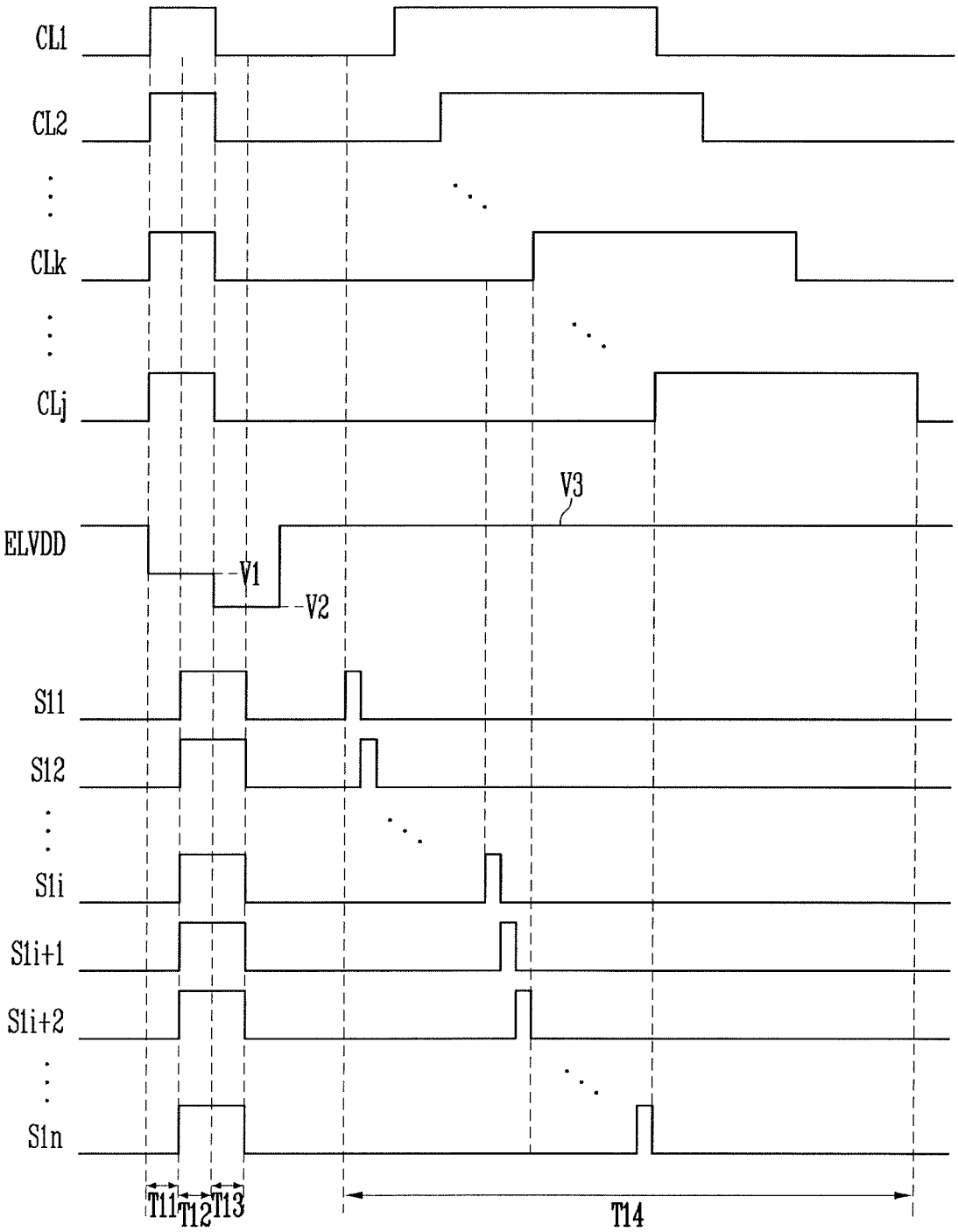
FIG. 9 illustrates a waveform diagram corresponding to another embodiment of a method for driving an organic light emitting display device.

FIG. 9 illustrates a waveform diagram of another embodiment of a method for driving the pixel of FIG. 8. In FIG. 8, it is assumed that the ith first scan line S1*i*, the (i+1)th first scan line S1*i*+1, and an (i+2)th first scan line S1*i*+2 are in the same block.

Referring to FIG. 9, first, a control signal is supplied to the control lines CL1 to CLj during an eleventh period T11 and a twelfth period T12 in one frame period 1F. In addition, the voltage of the first power source ELVDD is decreased to a first voltage V1 during the eleventh period T11 and the twelfth period T12.

When the control signal is supplied to the kth control line CLk, the voltage of the kth control line CLk is increased. Accordingly, the voltage of the second node N2 is increased. When the voltage of the second node N2 is increased, the first transistor M1 is turned on.

When the first transistor M1 is turned on, the first power source ELVDD and the anode electrode of the organic light emitting diode OLED are electrically coupled to each other. At this time, the first power source ELVDD is set to the first voltage V1 equal to or less than the voltage of the second power source ELVSS. Accordingly, the organic capacitor Coled is discharged.

A first scan signal is simultaneously supplied to the first scan lines S11 to S1*n* during the twelfth period T12 and a thirteenth period T13. When the first scan signal is supplied to the ith first scan line S1*i* and the (i+1)th first scan line S1*i*+1, the second transistor M2 and the third transistor M3 are turned on.

When the second transistor M2 and the third transistor M3 are turned on, the second node N2 and the first node N1 are electrically coupled to each other. Then, the second node N2 is initialized to approximately the first voltage V1 by the voltage of the organic capacitor Coled.

The supply of the control signal to the control lines CL1 to CLj is stopped in the thirteenth period T13. In addition, the voltage of the first power source ELVDD is decreased to a second voltage V2 less than the first voltage in the thirteenth period T13. Then, a predetermined current is supplied from the second node N2 to the first power source ELVDD via the first transistor M1 that is diode-coupled. In this case, a voltage corresponding to the threshold voltage of the first transistor M1 is applied to the second node N2.

The first capacitor C1 stores a voltage between the kth control line CLk and the second node N2 during the thirteenth period T13, e.g., a voltage corresponding to the threshold voltage of the first transistor M1 is stored in the first capacitor C1 during the thirteenth period T13.

All of the pixels PXL are simultaneously driven during the eleventh to thirteenth periods T11 to T13. Thus, the voltage corresponding to the threshold voltage of the first transistor M1 is stored in the first capacitor C1 in each of the pixels PXL during the eleventh to thirteenth periods T11 to T13.

The first power source ELVDD is set to a third voltage V3 greater than the first voltage V1 during a fourteenth period T14. The third voltage V3 may be set such that the pixels PXL emit light corresponding to a data signal.

The first scan signal is sequentially supplied to the first scan lines S11 to S1*n* during the fourteenth period T14. When the first scan signal is supplied to the ith first scan line S1*i*, the second transistor M2 is turned on. When the second transistor M2 is turned on, the second node N2 is electrically coupled to the third node N3.

The data signal is supplied to the data line Dm to be synchronized with the first scan signal supplied to the ith first scan line S1*i*. When the data signal is supplied to the data line Drn, the voltages of the third node N3 and the second node N2 are changed by coupling of the second capacitor C2. In this case, a variation in voltage of the second node N2 is determined corresponding to the voltage of the data signal supplied to the data line Dm. Accordingly, a voltage corresponding to the data signal is additionally stored in the first capacitor C1.

After the first scan signal is supplied to the ith first scan line S1*i*, the first scan signal is supplied to the (i+1)th first scan line S1*i*+1. When the first scan signal is supplied to the (i+1)th first scan line S1*i*+1, pixels PXL on an (i+1)th scan line stores a voltage corresponding to the data signal.

After the first scan signal is supplied to the (i+1)th first scan line S1*i*+1, the first scan signal is supplied to the (i+2)th first scan line S1*i*+2. When the first scan signal is supplied to the (i+2)th first scan line S1*i*+2, pixels PXL on an (i+2)th horizontal line stores a voltage corresponding to the data signal.

After the first scan signal is supplied to the ith first scan line S1*i*, the (i+1)th first scan line S1*i*+1, and the (i+2)th first scan line S1*i*+2, which are in the same block BL, the control signal is supplied to the kth control line CLk electrically coupled to pixels PXL in the same block BL.

When the control signal is supplied to the kth control line CLk, the voltage of the second node N2 in each of the pixels PXL coupled to the ith first scan line S1*i*, the (i+1)th first scan line S1*i*+1, and the (i+2)th first scan line S1*i*+2 is increased. At this time, the first transistor M1 supplies a current corresponding to the voltage of the second node N2 to the organic light emitting diode OLED. Accordingly, the organic light emitting diode OLED generates light with a predetermined luminance.

Thus, in this embodiment, the pixels PXL in the same block BL simultaneously emit light or do not simultaneously emit light. In addition, the pixels PXL sequentially emit light in units of blocks BL. Additionally, widths of control signals supplied to the control lines CL1 to CLj during the fourteenth period T14 are equal to one another. Accordingly, emission times of the pixels PXL are equal to one another regardless of the positions of the blocks BL.

Figure 10:
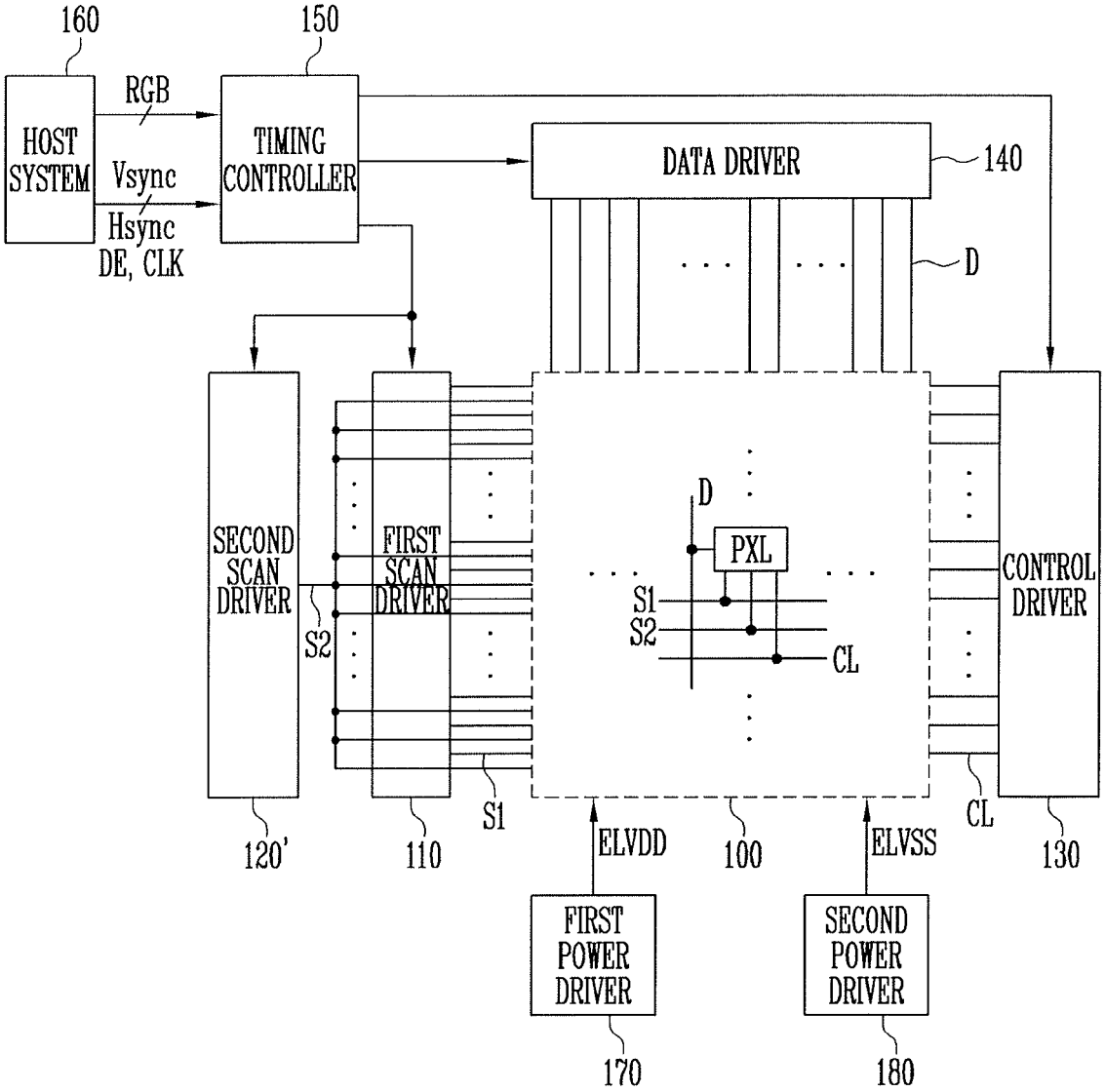
FIG. 10 illustrates another embodiment of an organic light emitting display device.

FIG. 10 illustrates another embodiment of an organic light emitting display device. In FIG. 10, components identical to those of FIG. 1 are designated by like reference numerals.

Referring to FIG. 10, the organic light emitting display device includes a pixel unit 100, a first scan driver 110, a second scan driver 120', a control driver 130, a data driver 140, a timing controller 150, a host system 160, a first power driver 170, and a second power driver 180.

A second scan line S2 is commonly coupled to pixels PXL and supplies a second scan signal from the second scan driver 120'. The second scan driver 120' supplies the second scan signal to the second scan line S2. For example, the second scan driver 120' may supply the second scan signal to the second scan line S2 during a twenty-second period T22 and a twenty-third period T23 in one frame period 1F, as illustrated, for example, in FIG. 12. The second scan signal is set to a gate-on voltage to turn on a transistor in each of the pixels PXL.

Figure 11:
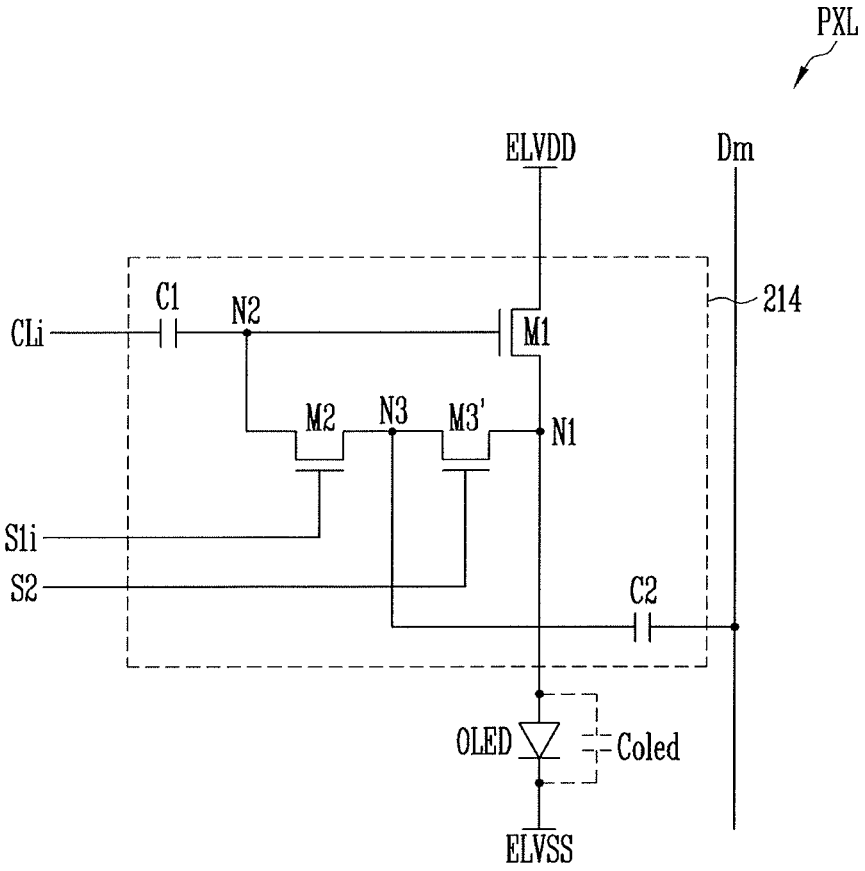
FIG. 11 illustrates another embodiment of a pixel.

FIG. 11 illustrates another embodiment of a pixel, which, for example, may be illustrative of the pixels PXL of FIG. 10. In FIG. 11, components identical to those of FIG. 3 are designated by like reference numerals.

Referring to FIG. 11, the pixel PXL includes an organic light emitting diode OLED and a pixel circuit 214 for controlling an amount of current supplied to the organic light emitting diode OLED. The organic light emitting diode OLED has an anode electrode coupled to the pixel circuit 214 and a cathode electrode coupled to a second power source ELVSS. The organic light emitting diode OLED generates light with a predetermined luminance corresponding to an amount of current supplied from the pixel circuit 214. The pixel circuit 214 controls the amount of current supplied to the organic light emitting diode OLED in accordance with a data signal.

The pixel circuit 214 includes a first transistor M1, a second transistor M2, a third transistor M3', a first capacitor C1, and a second capacitor C2. The third transistor M3' is coupled between a third node N3 and a first node N1. A gate electrode of the third transistor M3' is coupled to a second scan line S2. The third transistor M3' is turned on when a second scan signal is supplied to the second scan line S2, to allow the third node N3 and the first node N1 to be electrically coupled to each other.

Figure 12:
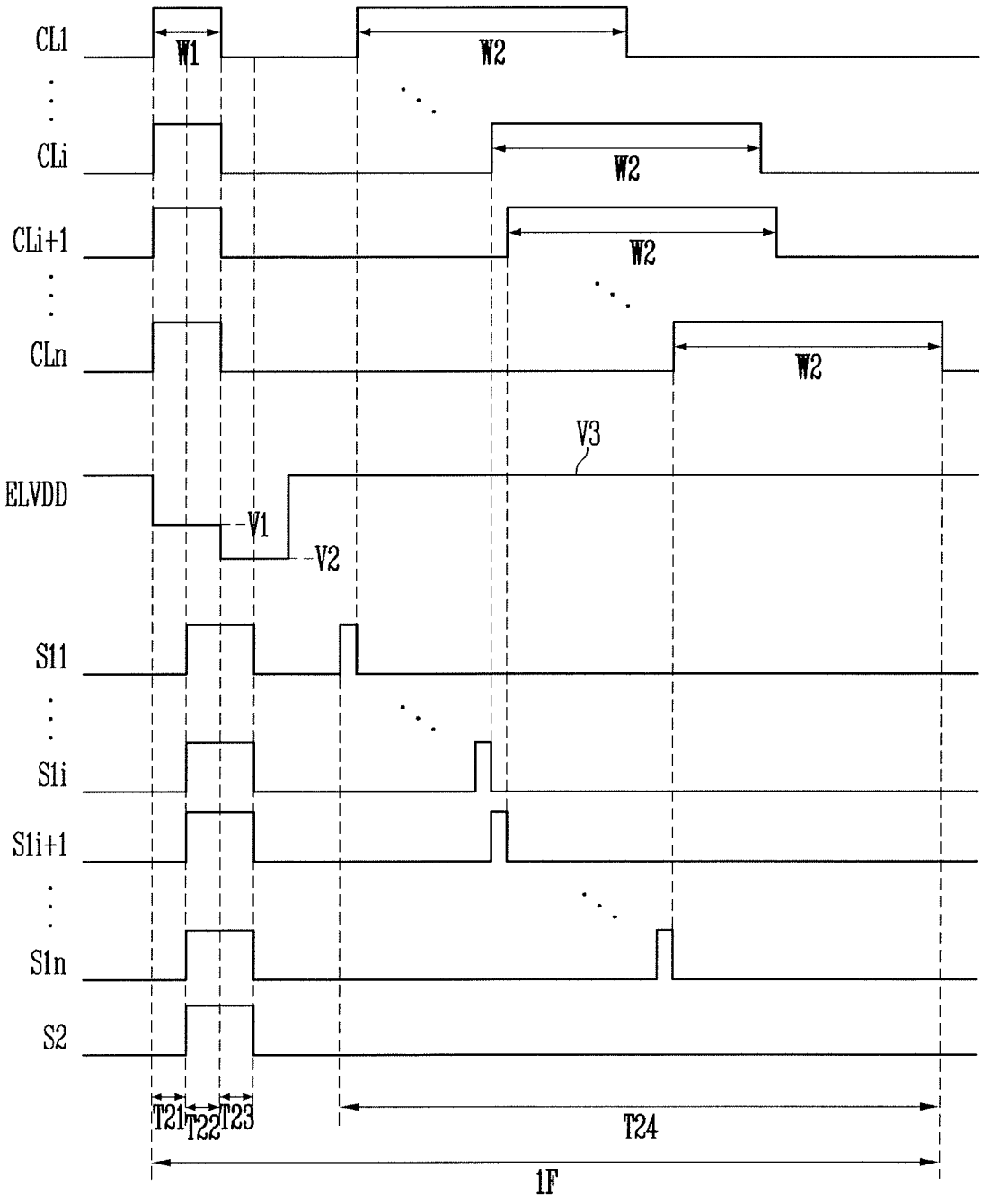
FIG. 12 illustrates a waveform diagram corresponding to another embodiment of a method for driving an organic light emitting display device.

FIG. 12 illustrates a waveform diagram of another embodiment of a method for driving a pixel, which, for example, may be the pixel of FIG. 11.

Referring to FIG. 12, first, a control signal is supplied to control lines CL1 to CLn during a twenty-first period T21 and a twenty-second period T22 in one frame period 1F. The voltage of a first power source ELVDD is decreased to a first voltage V1 during the twenty-first period T21 and the twenty-second period T22.

When the control signal is supplied to an ith control line CLi, the voltage of the ith control line CLi is increased. Accordingly, the voltage of a second node N2 is increased. When the voltage of the second node N2 is increased, the first transistor M1 is turned on.

When the first transistor M1 is turned on, the first power source ELVDD and the anode electrode of the organic light emitting diode OLED are electrically coupled to each other. Accordingly, an organic capacitor Coled is discharged.

A first scan signal is simultaneously supplied to first scan lines S11 to S1*n* during the twenty-second period T22 and a twenty-third period T23. A second scan signal is supplied to the second scan line S2 during the twenty-second period T22 and the twenty-third period T23. When the first scan signal is supplied to the first scan lines S11 to S1*n*, the second transistor M2 in each of the pixels PXL is turned on. When the second scan signal is supplied to the second scan line S2, the third transistor M3' in each of the pixels PXL is turned on.

When the second transistor M2 and the third transistor M3' are turned on, the second node N2 and the first node N1 are electrically coupled to each other. Then, the second node N2 is initialized to approximately the first voltage V1 by the voltage of the organic capacitor Coled.

Supply of the control signal to the control lines CL1 to CLn is stopped in the twenty-third period T23. In addition, the voltage of the first power source ELVDD is decreased to a second voltage V2 less than the first voltage V1 in the twenty-third period T23. Then, a predetermined current is supplied from the second node N2 to the first power source ELVDD via the first transistor M1 that is diode-coupled. In this case, a voltage corresponding to the threshold voltage of the first transistor M1 is applied to the second node N2.

The first capacitor C1 stores a voltage between the ith control line CLi and the second node N2 during the twenty-third period T23, e.g., a voltage corresponding to the threshold voltage of the first transistor M1 is stored in the first capacitor C1 during the twenty-third period T23.

All of the pixels PXL are simultaneously driven during the twenty-first to twenty-third periods T21 to T23. Thus, the voltage corresponding to the threshold voltage of the first transistor M1 is stored in the first capacitor C1 in each of the pixels PXL during the twenty-first to twenty-third periods T21 to T23.

The first power source ELVDD is set to a third voltage V3 greater than the first voltage V1 during a twenty-fourth period T24. Also, the first scan signal is sequentially supplied to the first scan lines S11 to S1*n* during the twenty-fourth period T24. When the first scan signal is supplied to the ith scan line S1*i*, the second transistor M2 is turned on. When the second transistor M2 is turned on, the second node N2 and the third node N3 are electrically coupled to each other.

Meanwhile, a data signal is supplied to a data line Dm in synchronization with the first scan signal supplied to the ith first scan line S1*i*. When the data signal is supplied to the data line Dm, the voltages of the third node N3 and the second node N2 are changed by coupling of the second capacitor C2. In this case, a variation in voltage of the second node N2 is determined corresponding to the voltage of the data signal supplied to the data line Dm. Accordingly, a voltage corresponding to the data signal is additionally stored in the first capacitor C1.

After the voltage corresponding to the data signal is stored in the first capacitor C1, the control signal is supplied to the ith control line CLi. When the control signal is supplied to the ith control line CLi, the voltage of the second node N2 is increased. At this time, the first transistor M1 supplies a current corresponding to the voltage of the second node N2 to the organic light emitting diode OLED. Accordingly, the organic light emitting diode OLED generates light with a predetermined luminance.

Figure 13:
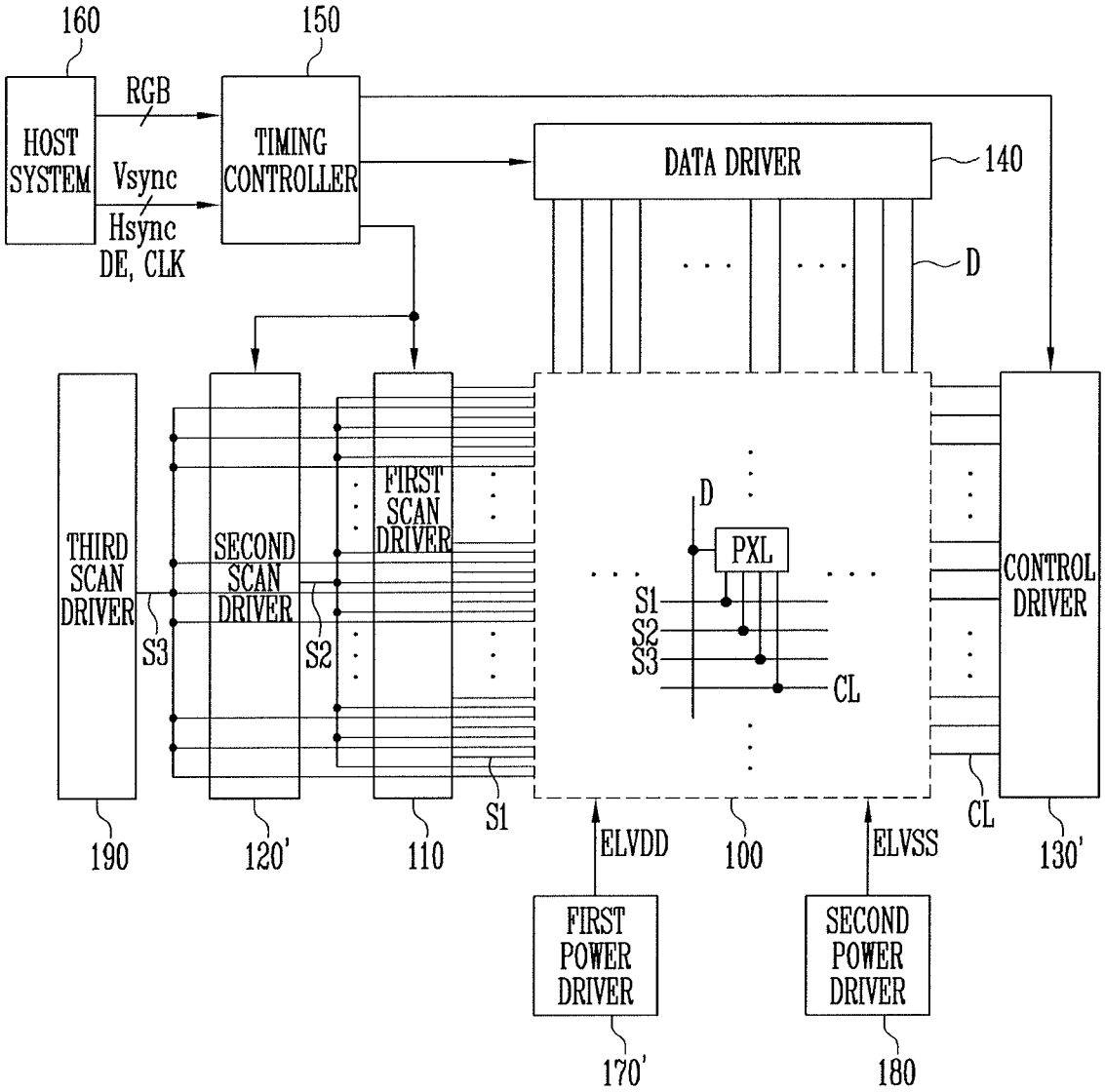
FIG. 13 illustrates another embodiment of an organic light emitting display device.

FIG. 13 illustrates another embodiment of an organic light emitting display device. In FIG. 13, components identical to those of FIG. 10 are designated by like reference numerals.

Referring to FIG. 13, the organic light emitting display device includes a pixel unit 100, a first scan driver 110, a second scan driver 120', a third scan driver 190, a control driver 130', a data driver 140, a timing controller 150, a host system 160, a first power driver 170', and a second driver 180.

The control driver 130' supplies a control signal to control lines CL. For example, the control driver 130' may sequentially supply the control signal to the control lines CL during a thirty-fourth period T34 in one frame period 1F, as illustrated, for example, in FIG. 15.

A third scan line S3 is commonly coupled to pixels PXL and supplies a third scan signal from the third scan driver 190. The third scan driver 190 supplies the third scan signal to the third scan line S3. For example, the third scan driver 190 may supply the third scan signal to the third scan line S3 during a thirty-first period T31 and a thirty-second period T32. The third scan signal is set to a gate-on voltage to turn on a transistor in each of the pixels PXL.

The first power driver 170' supplies a first power source ELVDD to the pixels PXL. The first power driver 170' supplies the first power source ELVDD having a second voltage during a thirty-third period T33, and supplies the first power source ELVDD having a third voltage V3 during the thirty-fourth period T34.

Figure 14:
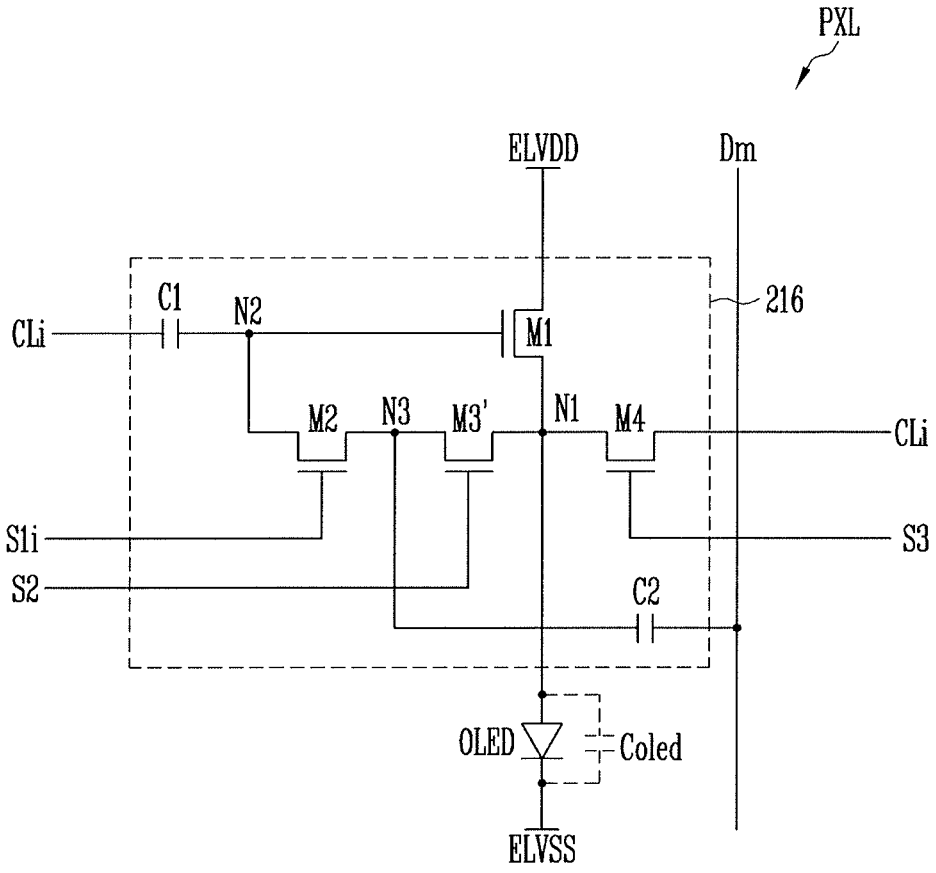
FIG. 14 illustrates another embodiment of a pixel.

FIG. 14 illustrates another embodiment of a pixel, which may be illustrative of the pixels PXL of FIG. 13. In FIG. 14, components identical to those of FIG. 11 are designated by like reference numerals.

Referring to FIG. 14, the pixel PXL includes an organic light emitting diode OLED and a pixel circuit 216 for controlling an amount of current supplied to the organic light emitting diode OLED. The organic light emitting diode OLED has an anode electrode coupled to the pixel circuit 216 and a cathode electrode coupled to a second power source ELVSS. The organic light emitting diode OLED generates light with a predetermined luminance corresponding to an amount of current supplied from the pixel circuit 216.

The pixel circuit 216 controls the amount of current supplied to the organic light emitting diode OLED in accordance with a data signal. The pixel circuit 216 includes a first transistor ml, a second transistor M2, a third transistor M3', a fourth transistor M4, a first capacitor C1, and a second capacitor C2. The fourth transistor M4 is coupled between a first node N1 and an ith control line CLi. A gate electrode of the fourth transistor M4 is coupled to the third scan line S3. When the third scan signal is supplied to the third scan line S3, the fourth transistor M4 is turned on to allow the first node N1 and the ith control line CLi to be electrically coupled to each other.

Figure 15:
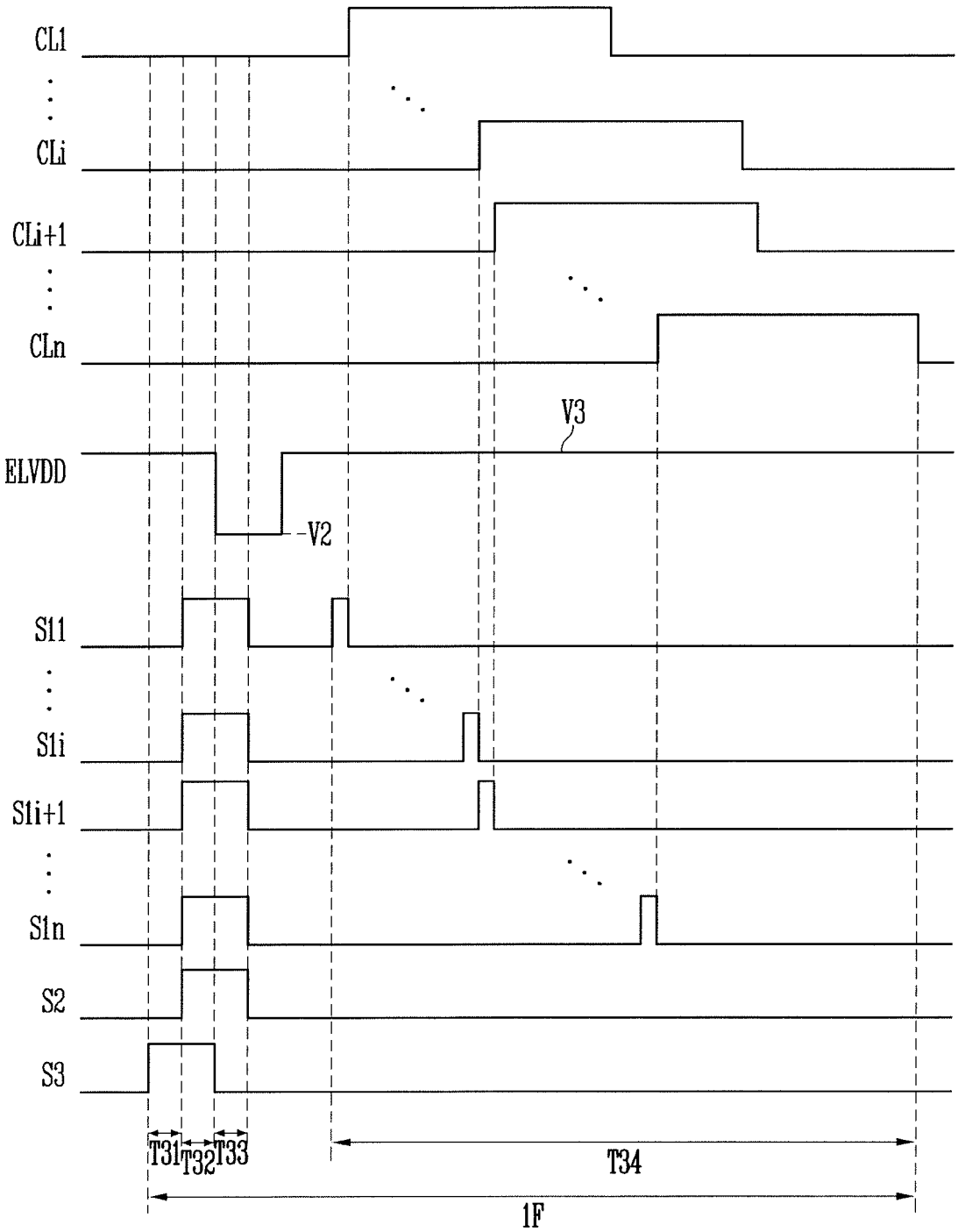
FIG. 15 illustrates a waveform diagram of another embodiment of a method for driving an organic light emitting display device.

FIG. 15 illustrates a waveform diagram of another embodiment of a method for driving a pixel, which, for example, may be the pixel of FIG. 14.

Referring to FIG. 15, first, a third scan signal is supplied to the third scan line S3 during a thirty-first period T31 and a thirty-second period T32 in one frame period 1F. When the third signal is supplied to the third scan line S3, the fourth transistor M4 is turned on. When the fourth transistor M4 is turned on, the ith control line CLi and the anode electrode of the organic light emitting diode OLED are electrically coupled to each other. At this time, since a low voltage (e.g., a voltage equal to a first voltage V1) is supplied to the ith control line CLi, an organic capacitor Coled is discharged.

A first scan signal is simultaneously supplied to first scan lines S11 to S1*n* during the thirty-second period T32 and a thirty-third period T33. In addition, a second signal is supplied to a second scan line S2 during the thirty-second period T32 and the thirty-third period T33. When the first scan signal is supplied to the first scan lines S11 to S1*n*, the second transistor M2 included in each of the pixels PXL is turned on. When the second scan signal is supplied to the second scan line S2, the third transistor M3' in each of the pixels PXL is turned on.

When the second transistor M2 and the third transistor M3' are turned on, a second node N2 and the first node N1 are electrically coupled to each other. Then, the second node N2 is initialized by the low voltage supplied from the ith control line CLi.

The supply of the third scan signal to the third scan line S3 is stopped in the thirty-third period T33. When the supply of the third scan signal to the third scan line S3 is stopped, the fourth transistor M4 is turned off. In addition, the first power source ELVDD is decreased to a second voltage in the thirty-third period T33. The second voltage V2 is set to a level sufficient to turn on the first transistor M1.

When the first transistor M1 is turned on, a predetermined current is supplied from the second node N2 to the first power source ELVDD via the first transistor M1 that is diode-coupled. In this case, a voltage corresponding to the threshold voltage of the first transistor M1 is applied to the second node N2. Then, the first capacitor C1 stores the voltage corresponding to the threshold voltage of the first transistor M1 during the thirty-third period T33.

Meanwhile, all of the pixels PXL are simultaneously driven during the thirty-first to thirty-third periods T31 to T33. Thus, the voltage corresponding to the threshold voltage of the first transistor M1 is stored in the first capacitor C1 in each of the pixels PXL during the thirty-first to thirty-third periods T31 to T33.

The first power source ELVDD is set to a third voltage V3 greater than the second voltage V2 during a thirty-fourth period T34. The third voltage V3 is set such that the pixels PXL emit light based on corresponding data signals.

The first scan signal is sequentially supplied to the first scan lines S11 to S1*n* during the thirty-fourth period 134. When the first scan signal is supplied to an ith first scan line S1*i*, the second transistor M2 is turned on. When the second transistor M2 is turned on, the second node N2 is electrically coupled to a third node N3.

Meanwhile, the data signal is supplied to a data line Dm in synchronization with the first scan signal supplied to the ith first scan line S1*i*. When the data signal is supplied to the data line Dm, voltages of the third node N3 and the second node N2 are changed by coupling of the second capacitor C2. In this case, a variation in voltage of the second node N2 is determined corresponding to the voltage of the data signal supplied to the data line Dm. Accordingly, a voltage corresponding to the data signal is additionally stored in the first capacitor C1.

After the voltage corresponding to the data signal is stored in the first capacitor C1, the control signal is supplied to the ith control line CLi. When the control signal is supplied to the ith control line CLi, the voltage of the second node N2 is increased. At this time, the first transistor M1 supplies a current corresponding to the voltage of the second node N2 to the organic light emitting diode OLED. Accordingly, the organic light emitting diode OLED generates light with a predetermined luminance.

Meanwhile, as described above, the fourth transistor M4 is added to the pixel circuit of FIG. 14, so that the voltage of the control lines CL1 to CLn may be maintained at a relatively low voltage during the thirty-first period T31 and the thirty-second period T32. In addition, when the fourth transistor M4 is added, the voltage of the first power source ELVDD may be maintained as the third voltage V3 during the thirty-first period T31 and the thirty-second period T32.

When the fourth transistor M4 is added, change in the voltages of the control lines CL1 to CLn and change in the voltage of the first power source ELVDD may be reduced or minimized. Accordingly, power consumption may be reduced or minimized.

Figure 16:
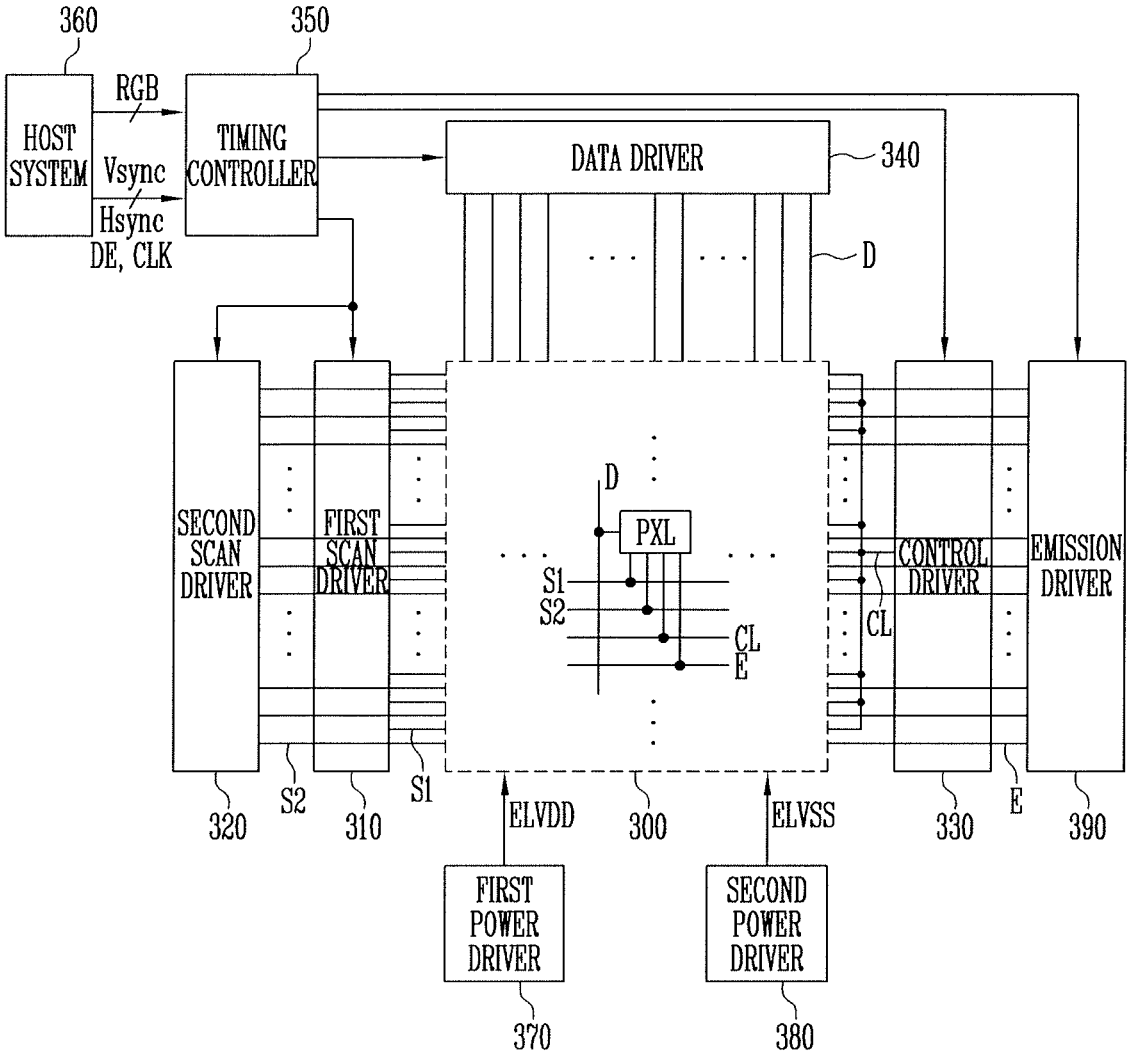
FIG. 16 illustrates another embodiment of an organic light emitting display device.

FIG. 16 illustrates another embodiment of an organic light emitting display device. Referring to FIG. 16, the organic light emitting display device includes a pixel unit 300, a first scan driver 310, a second scan driver 320, a control driver 330, a data driver 340, a timing controller 350, a host system 360, a first power driver 370, a second power driver 380, and an emission driver 390.

Figure 18:
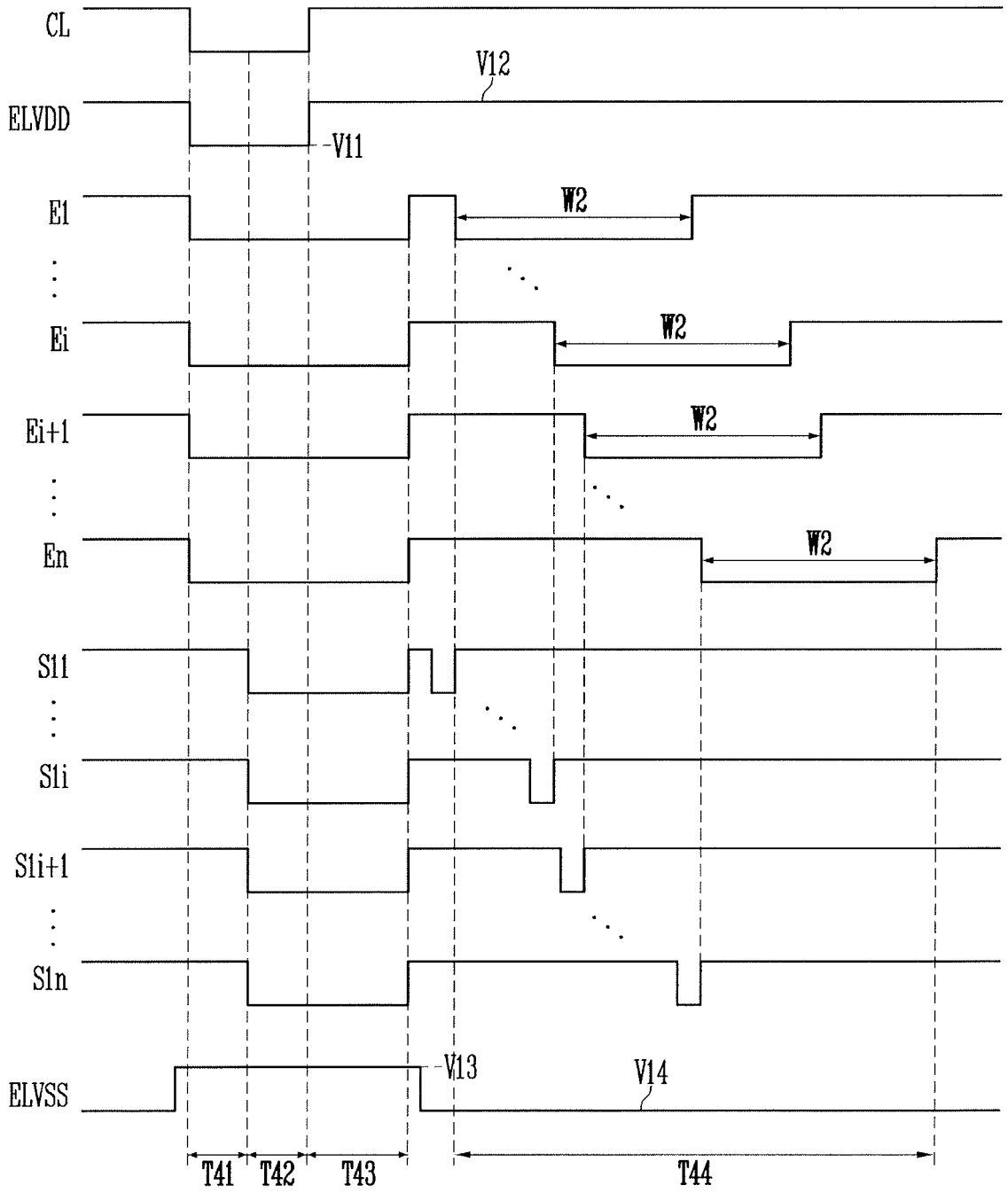
FIG. 18 illustrates a waveform diagram corresponding to another embodiment of a method for driving an organic light emitting display device.

In an embodiment, one frame period is divided into a forty-first period 141, a forty-second period T42, a forty-third period T43, and a forty-fourth period 144, as illustrated, for example, in FIG. 18.

The forty-first to forty-third periods T41 to T43 are periods for initializing pixels PXL, and all of the pixels PXL are simultaneously driven in the forty-first to forty-third periods T41 to T43. The forty-fourth period T44 is a period in which the pixels PXL emit light, and the pixels PXL are sequentially driven in the forty-fourth period T44.

The data driver 340 generates a data signal using image data input from the timing controller 350. The data signal generated by the data driver 340 is supplied to data lines D in synchronization with a first scan signal sequentially supplied to first scan lines S1 during the forty-fourth period T44. Additionally, the data driver 340 may supply a constant voltage between data signals. The constant voltage refers to a preset predetermined voltage and may be used to initialize the data lines D.

The first scan driver 310 supplies the first scan signal to the first scan lines S1. For example, the first scan driver 310 may simultaneously supply the first scan signal to the first scan lines S1 during the forty-second period T42 and the forty-third period T43, and sequentially supply the first scan signal to the first scan lines S1 during the forty-fourth period T44. When the first scan signal is supplied to the first scan lines S1, a transistor in each of the pixels PXL is turned on. The first scan signal is set to a gate-on voltage (e.g., a low voltage) to turn on the transistor in each of the pixels PXL.

The second scan driver 320 supplies a second scan signal to second scan lines S2. For example, the second scan driver 320 may simultaneously supply the second scan signal to the second scan lines S2 during the forty-second period T42 and the forty-third period T43. When the second scan signal is supplied to the second scan lines S2, the transistor in each of the pixels PXL is turned on. The second scan signal is set to the gate-on voltage (e.g., the lower voltage) to turn on the transistor in each of the pixels PXL.

The control driver 330 supplies a control signal (e.g., a low voltage) to a control line CL. The control line CL is commonly coupled to the pixels PXL. The control driver 330 supplies the control signal to the control line CL during the forty-first period T41 and the forty-second period T42.

The timing controller 350 controls the drivers 310, 320, 330, 340, 370, 380, and 390, based on timing and other signals output from the host system 360. Examples of these signals include image data RGB, a vertical synchronization signal Vsync, a horizontal synchronization signal Hsync, a data enable signal DE, and a clock signal CLK.

The host system 360 supplies the image data RGB to the timing controller 350 through a predetermined interface. Also, the host system 360 supplies the timing signals Vsync, Hsync, DE, and CLK to the timing controller 350.

The first power driver 370 supplies a first power source ELVDD to the pixels PXL. For example, the first power driver 370 may supply an eleventh voltage V11 during the forty-first period T41 and the forty-second period T42, and supply a twelfth voltage V12 during the forty-third period T43 and the forty-fourth period T44. The eleventh voltage V11 may be set as a voltage equal to or less than a fourteenth voltage V14 of a second power source ELVSS. In addition, the twelfth voltage V12 is set as a voltage greater than the eleventh voltage V11 such that the pixels PXL emit light.

The second power driver 380 supplies the second power source ELVSS to the pixels PXL. For example, the second power driver 380 may supply the second power source ELVSS having a thirteenth voltage V13 during the forty-first to forty-third periods T41 to T43, and supply the second power source ELVSS having the fourteenth voltage V14 during the forty-fourth period T44. The thirteenth voltage V13 is set such that the pixels PXL do not emit light, and the fourteenth voltage V14 is set to be less than the thirteenth voltage V13.

The emission driver 390 supplies an emission control signal to emission control lines E. For example, the emission driver 390 may simultaneously supply the emission control signal to the emission control lines E during the forty-first to forty-third periods T41 to T43. Also, the emission driver 390 may sequentially supply the emission control signal to the emission control lines E during the forty-fourth period T44. The emission control signal is set to the gate-on voltage (e.g., the low voltage) to turn on the transistor in each of the pixels PXL.

The pixel unit 300 includes a plurality of pixels PXL coupled to the data lines D, the first scan lines S1, the second scan lines S2, the control line CL, and the emission control lines E. Each of the pixels PXL supplies light with a predetermined luminance based on a corresponding data signal. In one embodiment, a second scan line S2*i* coupled to a pixel PXL on an ith horizontal line may be set as an (i+1)th first scan line S1*i*+1. The second scan driver 320 and the second scan lines S2 may be removed in one embodiment.

Figure 17:
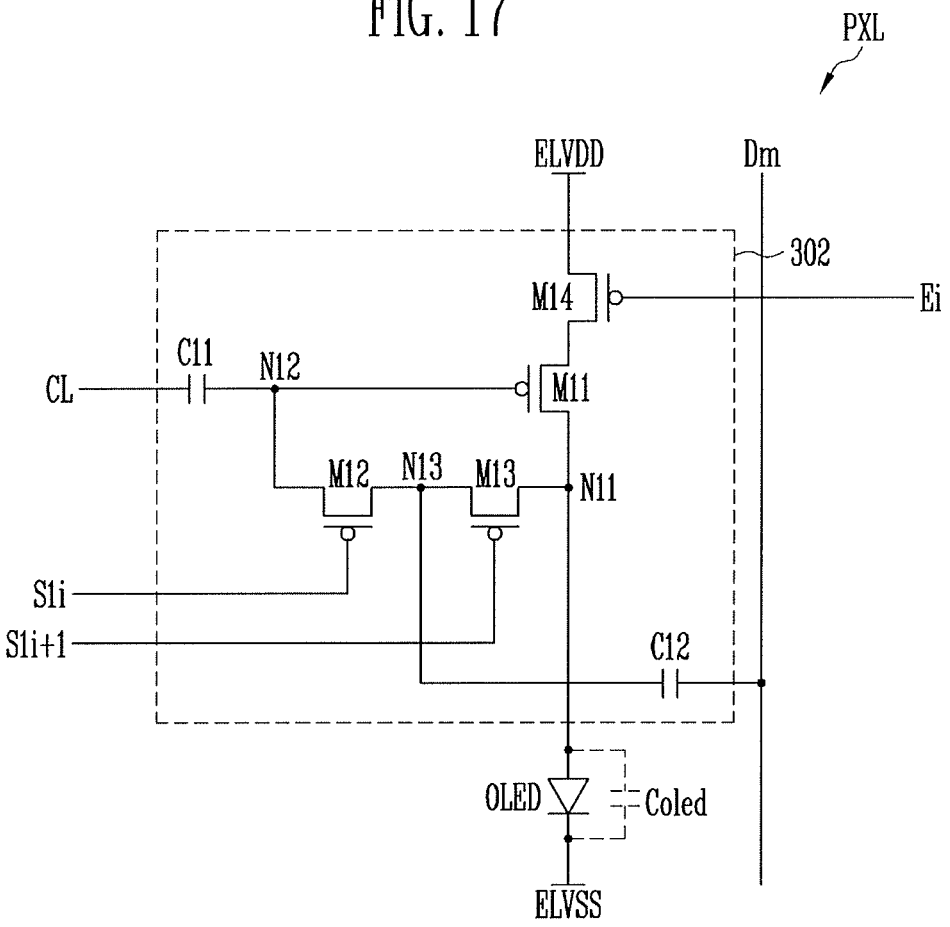
FIG. 17 illustrates another embodiment of a pixel.

FIG. 17 illustrates another embodiment of a pixel, which, for example, may be the pixel of FIG. 16. In FIG. 17, a pixel PXL on an ith horizontal line is illustrated for convenience of description. In addition, it is assumed that a second scan line S2*i* coupled to the pixel PXL located on the ith horizontal line is set as an (i+1)th first scan line S1*i*+1.

Referring to FIG. 17, the pixel PXL includes an organic light emitting diode OLED and a pixel circuit 302 for controlling an amount of current supplied to the organic light emitting diode OLED. The organic light emitting diode OLED has an anode electrode coupled to an eleventh node N11 of the pixel circuit 302 and a cathode electrode coupled to the second power source ELVSS. The organic light emitting diode OLED generates light with a predetermined luminance corresponding to an amount of current supplied from the pixel circuit 302. The pixel circuit 302 controls the amount of current supplied to the organic light emitting diode OLED.

The pixel circuit 302 includes an eleventh transistor M11, a twelfth transistor M12, a thirteenth transistor M13, a fourteenth transistor M14, an eleventh capacitor C11, and a twelfth capacitor C12. The eleventh transistor M11 is coupled between the fourteenth transistor M14 and the eleventh node N11. A gate electrode of the eleventh transistor M11 is coupled to a twelfth node N12. The eleventh transistor M11 controls an amount of current supplied from the first power source ELVDD to the second power source ELVSS, via the organic light emitting diode OLED, corresponding to a voltage of the twelfth node N12.

The twelfth transistor M12 is coupled between the twelfth node N12 and a thirteenth node N13. A gate electrode of the twelfth transistor M12 is coupled to an ith first scan line S1*i*. The twelfth transistor M12 is turned on when a first scan signal is supplied to the ith first scan line S1*i*, to allow the twelfth node N12 and the thirteenth node N13 to be electrically coupled to each other.

The thirteenth transistor M13 is coupled between the thirteenth node N13 and the eleventh node N11. A gate electrode of the thirteenth transistor M13 is coupled to an (i+1)th first scan line S1*i*+1. When a first scan signal is supplied to the (i+1)th first scan line S1*i*+1, the thirteenth transistor M13 is turned on to allow the thirteenth node N13 and the eleventh node N11 to be electrically coupled to each other.

The fourteenth transistor M14 is coupled between the first power source ELVDD and the eleventh transistor M11. A gate electrode of the fourteenth transistor M14 is coupled to an ith emission control line Ei. When an emission control signal is supplied to the ith emission control line Ei, the fourteenth transistor M14 is turned on to allow the first power source ELVDD and the eleventh transistor M11 to be electrically coupled to each other. In one embodiment, the eleventh to fourteenth transistors M11 to M14 may be formed as P-type transistors (e.g., PMOS transistors).

The eleventh capacitor C11 is coupled between the control line CL and the twelfth node N12. The eleventh capacitor C11 controls the voltage of the twelfth node N12 based on the control signal supplied to the control line CL. When the transistors M11 to M14 are P-type transistors, the control signal is set such that the voltage of the twelfth node N12 is decreased. The twelfth capacitor C12 is coupled between the data line Dm and the thirteenth node N13, and controls a voltage of the thirteenth node N13 based on the voltage of a corresponding data signal supplied to the data line Dm.

FIG. 18 illustrates a waveform diagram of another embodiment of a method for driving a pixel, which, for example, may be the pixel of FIG. 17.

Referring to FIG. 18, first, the second power source ELVSS is set to a thirteenth voltage V13 during forty-first to forty-third periods T41 to T43 in one frame period 1F. When the second power source ELVSS is set to the thirteenth voltage V13, the pixels PXL is set to a non-emission state.

In addition, an emission control signal is supplied to emission control lines E1 to En during the forty-first to forty-third periods T41 to T43 in the one frame period 1F. When the emission control signal is supplied to the emission control lines E1 to En, the fourteenth transistor M14 in each of the pixels PXL is turned on. When the fourteenth transistor M14 is turned on, the first power source ELVDD and the eleventh transistor M11 are electrically coupled to each other.

In addition, a control signal is supplied to the control line CL during the forty-first period T41 and the forty-second period T42 in the one frame period 1F. The voltage of the first power source ELVDD is decreased to an eleventh voltage V11 during the forty-first period T41 and the forty-second period T42.

When the control signal is supplied to the control line CL, the voltage of the twelfth node N12 is decreased by coupling of the eleventh capacitor C11 in each of the pixels PXL. When the voltage of the twelfth node N12 is decreased, the eleventh transistor M11 is turned on. The voltage of the control signal turns on the eleventh transistor M11 during the forty-first period T41.

When the eleventh transistor M11 is turned on, the first power source ELVDD and the anode electrode of the organic light emitting diode OLED are electrically coupled to each other. At this time, the first power source ELVDD is set to the eleventh voltage V11. Accordingly, an organic capacitor Coled is discharged.

A first scan signal is simultaneously supplied to first scan lines S11 to S1*n* during the forty-second period T42 and the forty-third period T43. When the first scan signal is simultaneously supplied to the first scan lines S11 to S1*n*, the twelfth transistor M12 and the thirteenth transistor M13 are turned on.

When the twelfth transistor M12 and the thirteenth transistor M13 are turned on, the twelfth node N12 and the eleventh node N11 are electrically coupled to each other. Then, the twelfth node N12 is initialized to approximately the eleventh voltage V11.

Supply of the control signal to the control line CL is stopped in the forty-third period T43. In addition, the voltage of the first power source ELVDD is increased to a twelfth voltage V12 greater than the eleventh voltage V11. The twelfth voltage V12 is set to maintain the eleventh transistor M11 in a turn-on state regardless of whether supply of the control signal is stopped.

Since the twelfth transistor M12 and the thirteenth transistor M13 are set to the turn-on state during the forty-third period T43, the eleventh transistor M11 is diode-coupled. Thus, a voltage corresponding to a threshold voltage of the eleventh transistor M11 is applied to the twelfth node N12 during the forty-third period T43. Accordingly, the voltage corresponding to the threshold voltage of the eleventh transistor M11 is stored in the eleventh capacitor C11.

All of the pixels PXL are simultaneously driven during the forty-first to forty-third periods T41 to T43. Thus, the voltage corresponding to the threshold voltage of the eleventh transistor M11 is stored in the eleventh capacitor C11 in each of the pixels PXL during the forty-first to forty-third periods T41 to T43.

Additionally, the forty-first to forty-third periods T41 to T43 are periods in which the pixels PXL are simultaneously driven, and sufficient time may be assigned to the forty-first to forty-third periods T41 to T43. As a result, threshold voltages of the pixels PXL may be stably compensated, making the pixels PXL suitable for use in high-resolution panels.

Supply of the emission control signal to the emission control lines E1 to En is stopped before a forty-fourth period T44. When supply of the emission control signal to the emission control lines E1 to En is stopped, the fourteenth transistor M14 in each of the pixels PXL is turned off.

In addition, the voltage of the second power source ELVSS is set to a fourteenth voltage V14 less than the thirteenth voltage V13 during the forty-fourth period T44. The first scan signal is sequentially supplied to the first scan lines S11 to S1*n* during the forty-fourth period T44. When the first scan signal is supplied to the ith first scan line S1*i*, the twelfth transistor M12 is turned on. When the twelfth transistor M12 is turned on, the twelfth node N12 is electrically coupled to the thirteenth node N13.

A data signal is supplied to the data line Dm in synchronization with the first scan signal supplied to the ith first scan line S1*i*. When the data signal is supplied to the data line Dm, voltages of the thirteenth node N13 and the twelfth node N12 are changed by coupling of the twelfth capacitor C12. In this case, a variation in voltage of the twelfth node N12 is determined based on the voltage of the corresponding data signal supplied to the data line Dm. Accordingly, a voltage corresponding to the data signal is additionally stored in the eleventh capacitor C11.

After the voltage corresponding to the data signal is stored in the eleventh capacitor C11, an emission control signal is supplied to the ith emission control line Ei. When the emission control signal is supplied to the ith emission control line Ei, the fourteenth transistor M14 is turned on. When the fourteenth transistor M14 is turned on, the first power source ELVDD and the eleventh transistor M11 are electrically coupled to each other. At this time, the eleventh transistor M11 controls the amount of current flowing from the first power source ELVDD to the second power source ELVSS, via the organic light emitting diode OLED, based on the voltage of the twelfth node N12.

The pixels PXL are sequentially supplied with corresponding data signals in units of horizontal lines during the forty-fourth period T44. Emission times of the pixels PXL are equal to one another and correspond to the emission control signal having a second width W2. Thus, the pixels PXL sequentially emit light in units of horizontal lines, and the emission times of the pixels PXL are equal to one another.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

The drivers, controllers, and other signal generating and signal processing features of the disclosed embodiments may be implemented in logic which, for example, may include hardware, software, or both. When implemented at least partially in hardware, the drivers, controllers, and other signal generating and signal processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the drivers, controllers, and other signal generating and signal processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

In accordance with one or more of the aforementioned embodiments, threshold voltages of the driving transistors in the pixels are simultaneously compensated. Accordingly, sufficient time may be provided in the period in which the threshold voltages are compensated. Thus, the threshold voltage of the driving transistor may be stably compensated, making the organic light emitting display device suitable to be used in providing high-resolution panels.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, various changes in form and details may be made without departing from the spirit and scope of the embodiments set forth in the claims.

What is claimed is:

1. An organic light emitting display device, comprising:

a plurality of pixels which includes a pixel on an ith (i is a natural number) horizontal line, the pixels being driven, with a frame period divided into a first period, a second period, a third period, and a fourth period, the pixel on the ith horizontal line including:

a first transistor coupled between a first power source and a first node, the first transistor having a gate electrode directly connected to a second node;

an organic light emitting diode coupled between the first node and a second power source;

at least one second transistor including a first electrode connected to the second node and a second electrode connected to a third node, the at least one second transistor to be turned on when a first scan signal is supplied to an ith first scan line;

at least one third transistor including a first electrode connected to the third node and a second electrode connected to the first node;

a first capacitor coupled between an ith control line and the second node; and a second capacitor coupled between the third node and a data line, wherein the second electrode of the at least one second transistor is directly connected to the first electrode of the at least one third transistor.

2. The display device as claimed in claim 1, wherein the at least one third transistor is to be turned on when the first scan signal is supplied to an (i+1)th scan line.

3. The display device as claimed in claim 1, further comprising:

a first scan driver to simultaneously supply the first scan signal to first scan lines during the second period and the third period, and sequentially supply the first scan signal to the first scan lines during the fourth period.

4. The display device as claimed in claim 1, further comprising:

a first power driver to supply a first power source having a first voltage during the first period and the second period, supply a first power source having a second voltage less than the first voltage during the third period, and supply a first power source having a third voltage greater than the first voltage during the fourth period.

5. The display device as claimed in claim 4, wherein:

the first voltage is equal to or less than a voltage of the second power source, and the third voltage is to cause the pixels to emit light.

6. The display device as claimed in claim 1, further comprising:

a control driver to simultaneously supply a control signal to control lines during the first period and the second period and to sequentially supply the control signal to the control lines during the fourth period.

7. The display device as claimed in claim 6, wherein the control driver is to supply the control signal to the ith control line after the first scan signal is supplied to the ith first scan line during the fourth period.

8. The display device as claimed in claim 1, wherein:

the first transistor, the at least one second transistor, and the at least one third transistor are N-type transistors, and a voltage of the second node is to be increased when a control signal is supplied to the ith control line.

9. The display device as claimed in claim 1, wherein the at least one second transistor includes a plurality of second transistors coupled in series.

10. The display device as claimed in claim 1, wherein the at least one third transistor includes a plurality of third transistors coupled in series.

11. The display device as claimed in claim 1, further comprising:

a second scan line commonly coupled to a gate electrode of the at least one third transistor in respective ones of the pixels.

12. The display device as claimed in claim 11, further comprising:

a second scan driver to supply a second scan signal to the second scan line during the second period and the third period.

13. The display device as claimed in claim 11, wherein:

the pixel on the ith horizontal line includes a fourth transistor coupled between the first node and the ith control line, and the fourth transistor has a gate electrode coupled to a third scan line commonly coupled to the pixels.

14. The display device as claimed in claim 13, further comprising:

a third scan driver to supply a third scan signal to the third scan line during the first period and the second period.

15. The display device as claimed in claim 13, further comprising:

a first power driver to supply a first power source having a second voltage during the third period and supply a first power source having a third voltage greater than the second voltage during the other periods.

16. The display device as claimed in claim 13, further comprising:

a control driver to sequentially supply a control signal to the control lines during the fourth period.

17. An organic light emitting display device, comprising:

a plurality of blocks, each of the plurality of blocks including at least two horizontal lines;

first scan lines corresponding to respective ones of the horizontal lines;

control lines corresponding to respective ones of the blocks; and a control driver to drive the control lines, wherein a pixel on an ith (i is a natural number) horizontal line of a kth (k is a natural number) block includes:

a first transistor coupled between a first power source and a first node, the first transistor having a gate electrode directly connected to a second node;

an organic light emitting diode coupled between the first node and a second power source;

a second transistor including a first electrode connected to the second node and a second electrode connected to a third node, the second transistor to be turned on when a first scan signal is supplied to an ith first scan line;

a third transistor including a first electrode connected to the third node and a second electrode connected to the first node, the third transistor to be turned on when the first scan signal is supplied to an (i+1)th first scan line;

a first capacitor coupled between a kth control line and the second node; and a second capacitor coupled between the third node and a data line, wherein the pixel is driven, with a frame period divided into a first period, a second period, a third period, and a fourth period, and the second electrode of the second transistor is directly connected to the first electrode of the third transistor.

18. The display device as claimed in claim 17, wherein the control driver is to simultaneously supply a control signal to the control lines during the first period and the second period, and sequentially supply the control signal to the control lines during the fourth period.

19. The display device as claimed in claim 18, wherein:

the first transistor, the second transistor, and the third transistor are N-type transistors, and a voltage of the second node is to be increased when the control signal is supplied to the kth control line.

20. The display device as claimed in claim 18, wherein the control driver is to supply the control signal to the kth control line after the first scan signal is supplied to first scan lines in the kth block during the fourth period.

21. The display device as claimed in claim 17, further comprising:

a first scan driver to simultaneously supply the first scan signal to the first scan lines during the second period and the third period, and sequentially supply the first scan signal to the first scan lines during the fourth period.

22. The display device as claimed in claim 17, further comprising:

a first power driver to supply a first power source having a first voltage during the first period and the second period, supply a first power source having a second voltage less than the first voltage during the third period, and supply a first power source having a third voltage greater than the first voltage during the fourth period.

23. An organic light emitting display device, comprising:

a plurality of pixels including a pixel on an ith (i is a natural number) horizontal line, the pixels being driven, with a frame period divided into a first period, a second period, a third period, and a fourth period, the pixel including:

a first transistor coupled between a first power source and a first node, the first transistor having a gate electrode directly connected to a second node;

an organic light emitting diode coupled between the first node and a second power source;

a second transistor including a first electrode connected to the second node and a second electrode connected to a third node, the second transistor to be turned on when a first scan signal is supplied to an ith first scan line;

a third transistor including a first electrode connected to the third node and a second electrode connected to the first node, the third transistor to be turned on when the first scan signal is supplied to an (i+1)th first scan line;

a fourth transistor coupled between the first power source and the first transistor, the fourth transistor to be turned on when an emission control signal is supplied to an ith emission control line;

a first capacitor coupled between a control line commonly coupled to the pixels and the second node; and a second capacitor coupled between the third node and a data line, wherein the second electrode of the second transistor is directly connected to the first electrode of the third transistor.

24. The display device as claimed in claim 23, further comprising:

a control driver to supply a control signal to the control line during the first period and the second period.

25. The display device as claimed in claim 24, wherein:

the first transistor, the second transistor, the third transistor, and the fourth transistor are P-type transistors, and a voltage of the second node is to be decreased when the control signal is supplied to the control line.

26. The display device as claimed in claim 23, further comprising:

an emission driver to simultaneously supply the emission control signal to the emission control lines during the first period, the second period, and the third period and sequentially supply the emission control signal to the emission control lines during the fourth period.

27. The display device as claimed in claim 26, wherein the emission driver is to supply the emission control signal to the ith emission control line after the first scan signal is supplied to the ith first scan line.

28. The display device as claimed in claim 23, further comprising:

a first scan driver to simultaneously supply the first scan signal to the first scan lines during the second period and the third period and sequentially supply the first scan signal to the first scan lines during the fourth period.

29. The display device as claimed in claim 23, further comprising:

a first power driver to supply a first power source having a first voltage during the first period and the second period and supply a first power source having a second voltage greater than the first voltage such that the pixels emit light during the fourth period.

30. The display device as claimed in claim 23, further comprising:

a second power driver coupled to a second power source having a third voltage such that the pixels do not emit light during the first period, the second period, and the third period, and to supply a second power source having a fourth voltage less than the third voltage such that the pixels emit light during the fourth period.

31. A method for driving an organic light emitting display device based on a frame period divided into a first period, a second period, a third period, and a fourth period, the method comprising:

during the first period, initializing an anode electrode of an organic light emitting diode in each of pixels to a specific voltage, the specific voltage corresponding to a first voltage supplied to the pixels through a first power source;

during the second period, initializing a gate electrode of a driving transistor in each of the pixels to the specific voltage;

during the third period, storing a voltage corresponding to a threshold voltage of the driving transistor in a first capacitor in each of the pixels; and during the fourth period, sequentially supplying data signals to the pixels in units of horizontal lines and allowing the pixels to sequentially emit light based on corresponding ones of the data signals and a third voltage supplied to the pixels through the first power source, wherein the first power source has the first voltage in the first period and the second period, wherein the first power source has a second voltage lower than the first voltage in the third period, and wherein the first power source has the third voltage higher than the first voltage in the fourth period.

* * * * *